US010695889B2

(12) United States Patent
Li et al.

(10) Patent No.: US 10,695,889 B2
(45) Date of Patent: Jun. 30, 2020

(54) MULTI-ANGLE TWO-DIMENSIONAL ULTRASONIC VIBRATION ASSISTED NANOFLUID MICRO-LUBRICATION GRINDING DEVICE

(71) Applicant: QINGDAO TECHNOLOGICAL UNIVERSITY, Qingdao (CN)

(72) Inventors: Changhe Li, Qingdao (CN); Xianpeng Zhang, Qingdao (CN); Yanbin Zhang, Qingdao (CN); Min Yang, Qingdao (CN); Shuming Guo, Qingdao (CN); Naiqing Zhang, Qingdao (CN); Qidong Wu, Qingdao (CN); Huajun Cao, Qingdao (CN)

(73) Assignee: QINGDAO TECHNOLOGICAL UNIVERSITY, Qingdao (CN)

( * ) Notice: Subject to any disclaimer, the term of this patent is extended or adjusted under 35 U.S.C. 154(b) by 241 days.

(21) Appl. No.: 15/755,251

(22) PCT Filed: Feb. 21, 2017

(86) PCT No.: PCT/CN2017/074305
§ 371 (c)(1),
(2) Date: Feb. 26, 2018

(87) PCT Pub. No.: WO2018/049790
PCT Pub. Date: Mar. 22, 2018

(65) Prior Publication Data

US 2018/0354096 A1 Dec. 13, 2018

(30) Foreign Application Priority Data

Sep. 14, 2016 (CN) ..... 2016 1 08243250
Sep. 14, 2016 (CN) ..... 2016 2 10553513 U

(51) Int. Cl.
*B24B 55/02* (2006.01)
*B24B 1/04* (2006.01)
(Continued)

(52) U.S. Cl.
CPC ..... *B24B 55/02* (2013.01); *B24B 1/04* (2013.01); *B24B 41/067* (2013.01); *B24B 49/03* (2013.01);
(Continued)

(58) Field of Classification Search
CPC ..... B24B 55/02; B24B 1/04; B24B 41/067; B24B 49/03; B24B 49/10; B24B 49/14
See application file for complete search history.

(56) References Cited

U.S. PATENT DOCUMENTS 9,925,638 B2 * 3/2018 Li ..... B24B 55/02
2015/0126097 A1 * 5/2015 Li ..... B05B 5/03 451/450
2018/0056481 A1 * 3/2018 Yoshida ..... B24B 49/12

FOREIGN PATENT DOCUMENTS

CN 101760285 A 6/2010
CN 102490088 A 6/2012
(Continued)

OTHER PUBLICATIONS

May 5, 2017 International Search Report issued in International Patent Application No. PCT/CN2017/074305.
(Continued)

*Primary Examiner* — Dung Van Nguyen
(74) *Attorney, Agent, or Firm* — Oliff PLC

(57) ABSTRACT

A multi-angle two-dimensional ultrasonic vibration assisted nanofluid micro-lubrication grinding device includes a workpiece fixture for clamping a workpiece and a grinding wheel for grinding the workpiece, the fixture being connected with a two-dimensional ultrasonic vibration device to
(Continued)

maintain the sharpness of the grinding wheel cutting edge and cool the grinding temperature on the workpiece surface; a jetting mechanism used for jetting nanofluid to the workpiece is arranged on one side of the grinding wheel so as to form two-dimensional ultrasonic vibration and nanofluid micro-lubrication grinding coupling; the device applies the variable-angle two-dimensional ultrasonic vibration technology to grinding processing, and adjusts the angles of two ultrasonic vibrators to generate different combined vibration directions to change the relative movement trajectories of abrasive particles and a workpiece. A grinding force and grinding temperature are detected in real time by force measurement and temperature measurement devices, meanwhile cooperation with nanofluid micro-lubrication is utilized.

10 Claims, 11 Drawing Sheets

(51) Int. Cl.

| | |
|---|---|
| ***B24B 49/10*** | (2006.01) |
| ***B24B 49/03*** | (2006.01) |
| ***B24B 41/06*** | (2012.01) |
| *B24B 49/14* | (2006.01) |
| *B24D 7/10* | (2006.01) |

(52) U.S. Cl.

CPC ..... *B24B 49/10* (2013.01); *B24B 49/14* (2013.01); *B24D 7/10* (2013.01)

(56) References Cited

FOREIGN PATENT DOCUMENTS

| | | | |
|---|---|---|---|
| CN | 203432882 | U | 2/2014 |
| CN | 103769959 | A | 5/2014 |
| CN | 104526471 | A | 4/2015 |
| CN | 205006970 | U | 2/2016 |
| CN | 106181596 | A | 12/2016 |
| GB | 946292 | A | 1/1964 |
| JP | S63-62662 | A | 3/1988 |

OTHER PUBLICATIONS

May 5, 2017 Written Opinion issued in International Patent Application No. PCT/CN2017/074305.

* cited by examiner

A-A

MULTI-ANGLE TWO-DIMENSIONAL ULTRASONIC VIBRATION ASSISTED NANOFLUID MICRO-LUBRICATION GRINDING DEVICE

FIELD OF THE INVENTION

The present invention relates to the field of grinding processing, in particular to a multi-angle two-dimensional ultrasonic vibration assisted nanofluid micro-lubrication grinding device.

BACKGROUND OF THE INVENTION

With the development of science and technology, the demand for materials difficult to process and novel advanced materials is increasing day by day, and higher requirements are proposed for the processing efficiency, the processing quality and the processing precision of key parts and components. The traditional grinding methods are inevitable to generate greater grinding forces and grinding heat, resulting in a series of problems such as damages to surfaces/subsurfaces of workpieces, low service lives of grinding wheels and the like. Especially in the field of precision and ultra-precision processing, and the existence of these processing defects seriously hinders the improvement of the processing precision and the processing efficiency of the parts and components.

Therefore, it is very necessary to reduce the grinding force and the grinding heat and improve the grinding quality and efficiency in a grinding process.

Nanofluid micro-lubrication grinding not only inherits all the advantages of micro-lubrication grinding, but also solves the heat exchange problem of the micro-lubrication grinding processing, thereby being a green and environmentally-friendly grinding processing technology with high efficiency and low power efficiency. Based on the heat transfer enhancement theory that the heat exchange capability of solid is greater than that of liquid and the heat exchange capability of liquid is greater than that of gas, a certain amount of nanoscale solid particles are added to degradable trace lubricating oil to generate nanofluid, and the nanofluid is atomized by high pressure air and is conveyed into a grinding area in a jet flow manner. The high-pressure air mainly plays the functions of cooling, removing abrasive dust and conveying the fluid; the trace lubricating oil mainly plays a lubricating function; the nano particles improve the heat exchange capability of the fluid in the grinding area so as to achieve a cooling function, and meanwhile the nano particles have good wear resistance and friction reduction properties and high carrying capacity, so that the lubricating effect of the grinding area is further improved, the surface quality and the burn phenomenon of the workpieces are significantly improved, the service life of the grinding wheel is prolonged, and the working environment is improved.

Ultrasonic vibration refers to converting 220V or 380V AC into ultrasonic frequency electric oscillation signals with power of 300 W and frequency of 16 kHz via an ultrasonic generator and applying the electric signals to a transducer to produce mechanical vibration with the same frequency, the amplitude of the vibration is amplified by an amplitude modulator, and a large enough mechanical vibration amplitude is finally produced on the end part of a tool. The ultrasonic generator is mainly composed of an oscillator, a voltage amplifier, a power amplifier, an output transformer and other components. The oscillator is the core of the ultrasonic generator. According to the needs of ultrasonic processing, the output waveform of the ultrasonic generator can be a sine wave or a non-sine wave, but the sine wave is the most common. An ultrasonic transducer is an energy conversion device that converts an alternating electrical signal into a sound signal or converting a sound signal in an external sound field into an electrical signal within an ultrasonic frequency range, and the commonly used transducers include hysteresis transducers and piezoelectric transducers. An ultrasonic amplitude modulator is an important component of an ultrasonic system, it is used for transferring mechanical energy converted from the electric energy transmitted by the transducer to a processed workpiece, and the ultrasonic amplitude modulator is a mechanical amplification stage of power ultrasonic amplitude and is used for improving the ultrasonic processing effect. In the grinding processing, in a plastic deformation process of the workpiece material, the deformation amount of the processed surface and the abrasion degree of grinding wheel are all related to the interaction conditions of contact surfaces between abrasive particles and the workpiece in the grinding process, that is to say, are related to their time and space conditions. When the ultrasonic vibration is applied to the process system, the interaction conditions of various contact surfaces between the abrasive particles and the workpiece are greatly different from those of ordinary grinding. Although small-amplitude high-frequency vibration generates no influence on the size and shape of the surface of the workpiece, but greatly changes the friction and wear conditions of the abrasive particles to produce additional reciprocating motion on the contact surfaces between the abrasive particles and the workpiece, so that the contact surfaces between the abrasive particles and the workpiece generate cyclical separation, grinding liquid can better enter a friction area between the grinding wheel and a workpiece interface to reduce the generation of the grinding force and the grinding heat, and the outflow resistance of the abrasive dust can also be reduced so as to efficiently clean the abrasive dust in the grinding area. Moreover, the ultrasonic vibration causes the abrasive particles to produce intermittent cutting action, while the impact load makes the material of the workpiece be convoluted more easily, more micro cracks are generated in a cutting area to reduce the grinding force and the friction coefficient. The plastic deformation of the material in the grinding process occurs mainly in sliding friction and plowing action phases, as the ultrasonic vibration grinding is pulsed intermittent grinding, the proportion of the sliding friction and plowing is relatively reduced, so that the grinding energy is reduced, and the surface thermal damage is also significantly reduced.

In the prior art, the implementation of an ultrasonic vibration grinding tool includes a connecting piece matched with a shank of a numerical control machine tool or a drilling machine, the connecting piece is used for connecting an ultrasonic vibration grinding compound processing tool with the shank of the numerical control machine tool or the drilling machine, different connecting pieces can be made according to different shanks, and this structure can be detached at any time to achieve multiple purposes of one machine. A main spindle is installed on the connecting piece, a transducer is installed on the main spindle, the transducer is connected with an amplitude change rod, a cutter is installed on the amplitude change rod, and the transducer is connected with an ultrasonic generator through a carbon brush. The ultrasonic vibration is applied to the main spindle, which involves the reformation of the machine tool, thereby being difficult to achieve, moreover, it is hard to guarantee the precision of the ultrasonic vibration applied to the main spindle of the machine tool, and the dissipation to the main spindle is relatively large, so that further improvement and optimization are needed.

A low-temperature cooling and nano particle jet flow micro-lubrication coupled grinding medium supply system includes at least one micro-lubrication and low-temperature cooling nozzle combination unit which is arranged on a side face of a grinding wheel cover of a grinding wheel and is matched with the workpiece on a worktable; the unit includes a micro-lubrication atomizing micro-nozzle and a low-temperature cooling nozzle, the micro-lubrication atomizing micro-nozzle is connected with a nanofluid pipeline and a compressed air pipeline, and the low-temperature cooling nozzle is connected with a low-temperature cooling liquid pipeline; the nanofluid pipeline, the compressed air pipeline and the low-temperature cooling liquid pipeline of each unit are connected with a nanofluid supply system, a low-temperature medium supply system and a compressed air supply system through control valves, and the nanofluid supply system, the low-temperature medium supply system and the compressed air supply system are connected with a control device. In the present invention, the low-temperature cooling is combined with nano particle jet flow micro-lubrication, thereby reducing the grinding heat and achieving a good cooling effect, but no double optimization effect is achieved on the aspect of grinding force.

An ultrasonic vibration assisted grinding device includes a disc-shaped turntable lower base, a disc-shaped turntable upper base, an amplitude change rod clamping device lower base, an amplitude change rod clamping device upper base, an ultrasonic generator connected with an amplitude change rod and a workpiece supporting platform arranged on a dynamometer, the disc-shaped turntable lower base and the disc-shaped turntable upper base are in concentric locating rotary connection, and the amplitude change rod is fixed between the amplitude change rod clamping device lower base and the amplitude change rod clamping device upper base in a convolution clamping manner. The ultrasonic vibration on any direction is achieved by the precise rotation of the turntable lower base and the turntable upper base; the workpiece supporting platform plane can be conveniently adjusted to be horizontal in the convolution clamping manner; and the dynamometer is only connected with the turntable lower base, and thus the forces on three directions of the grinding wheel can also be measured when the amplitude change rod rotates at any angle. In the present invention, an ultrasonic vibrator is supported by a supporter with a disc and has only one supporting point, so that the stability of the system cannot be guaranteed. Moreover, the one-dimensional ultrasonic vibration grinding has its limitations and needs to meet certain processing parameter conditions to achieve an ideal processing effect.

In summary, in the prior art, the relative movement trajectories of the abrasive particles of the grinding wheel and the workpiece are consistent, excessive damage to a cutting edge is caused easily by the long-term operation, the grinding wheel needs to be re-polished, thereby delaying the processing period of the workpiece; and moreover, the workpiece is unlikely to be cooled due to the long-term operation, thereby generating thermal damage to the workpiece easily. In addition, the grinding force and the grinding temperature cannot be detected in real time and online in the prior art.

SUMMARY OF THE INVENTION

In view of the above problems, in order to solve the deficiencies in the prior art, the objective of the present invention is to provide a multi-angle two-dimensional ultrasonic vibration assisted nanofluid micro-lubrication grinding device. The device applies the variable-angle two-dimensional ultrasonic vibration technology to the grinding processing, and adjusts the angles of two ultrasonic vibrators to generate different combined vibration directions so as to change the relative movement trajectory of abrasive particles and a workpiece. A grinding force and a grinding temperature are detected in real time by a force measurement device and a temperature measurement device, meanwhile a grinding action mechanism is formed on an interface of a grinding wheel and the workpiece in cooperation with nanofluid micro-lubrication so as to further improve the processing quality of the workpiece and prevent the thermal damage to the workpiece.

The Solution Provided by the Present Invention is as Follows:

The multi-angle two-dimensional ultrasonic vibration assisted nanofluid micro-lubrication grinding device includes a workpiece fixture used for clamping a workpiece and a grinding wheel used for grinding the workpiece, wherein the workpiece fixture is connected with a two-dimensional ultrasonic vibration device to maintain the sharpness of a cutting edge of the grinding wheel; in order to prevent the thermal damage to the workpiece, a jetting mechanism used for jetting nanofluid to the workpiece is arranged on one side of the grinding wheel, and the two-dimensional ultrasonic vibration device and nanofluid jetted by the jetting mechanism form two-dimensional ultrasonic vibration and nanofluid micro-lubrication grinding coupling of the workpiece; the nanofluid is atomized and jetted to a grinding area by an oil-gas two-phase flow nozzle so as to form a grinding action mechanism on the ultrasonic vibration coupling; and while the cooling and lubricating performance in a grinding process is improved, the surface quality of the workpiece is further improved, and the grinding heat is effectively reduced.

The two-dimensional ultrasonic vibration device includes a tangential ultrasonic vibration device and an axial ultrasonic vibration device, the tangential ultrasonic vibration device is arranged above or below the axial ultrasonic vibration device, and the tangential ultrasonic vibration device is parallel to the grinding direction of the grinding wheel; and the tangential ultrasonic vibration device is rotatably arranged relative to the axial ultrasonic vibration device, the adjusting range of an included angle is 40° to 180°, the angle is adjustable, so that the abrasive particles and the workpiece generate different relative movement trajectories, thereby achieving different grinding effects, forming more dense texture veins on the grinding surface of the workpiece and improving the surface quality of the workpiece.

The tangential ultrasonic vibration device is arranged on a fixing plate, the fixing plate is arranged on a worktable, the axial ultrasonic vibration device is arranged above the tangential ultrasonic vibration device, the fixing plate is connected with a dynamometer, and the dynamometer is connected with a grinding force control system.

A temperature collection element is arranged on the workpiece fixture or the workpiece, and the temperature collection element is connected with the temperature control system, wherein a through hole is formed in the workpiece, the temperature collection element such as a thermocouple wire is embedded in the hole and is led out from the bottom of the workpiece to be connected with the temperature control system.

The tangential ultrasonic vibration device is fixed to the fixing plate through a tangential bracket with an L-shaped longitudinal section, the top of the tangential bracket supports a tangential amplitude change rod, one end of the tangential amplitude change rod is connected with a tangential transducer, the tangential transducer is connected with an ultrasonic generator, the other end of the tangential amplitude change rod is connected with a slide rail supporting seat, and the slide rail supporting seat supports the workpiece fixture; a universal joint is a universal ball joint, the universal ball joint includes a universal joint ball core, a universal joint ball shell and a universal joint nut, and Vaseline oil should be coated on contact areas of the three parts to reduce the energy loss in an ultrasonic vibration transfer process.

The axial ultrasonic vibration device includes an axial amplitude change rod, one end of the axial amplitude change rod is connected with an axial transducer, the other end of the axial amplitude change rod is connected with an axial supporting seat, and the axial supporting seat is arranged in a depression on a lower surface of the slide rail supporting seat or an upper surface of the slide rail supporting seat through a T-shaped slide block; the axial transducer is connected with the ultrasonic generator;

an arc-shaped slot for limiting the movement trajectory of the axial ultrasonic vibration device is arranged on the fixing plate, a slide bar is arranged on an axially adjustable bracket, and the slot moves along an arc-shaped slide rail; and further, the chute is a T-shaped chute, and the slide bar can be replaced by a locating bolt.

A slide block rolling ball is arranged on at least one side face of the T-shaped slide block to avoid the vibration damage to the slide rail supporting seat and the axial supporting seat; and or, a jack is arranged at the bottom of the T-shaped slide block, a jack rolling ball is arranged on a contact surface of the jack and the T-shaped slide block to reduce the energy consumed by the friction between a bottom surface of the TI-shaped slide block and the jack, the jack is an oil jack, which includes a lifting sleeve, the lifting sleeve is arranged in a shell, a hydraulic oil inlet and outlet is formed in the bottom of the shell, and hydraulic oil is pressurized into an oil cavity through an external oil pressurization device.

The ultrasonic generator is mainly composed of a voltage amplifier, a power amplifier, an oscillator and an output transformer, and the oscillator is the core. The ultrasonic generator has a signal feedback function, and can provide a frequency tracking signal and an output power feedback signal.

In the case of voltage instability, the output power of the ultrasonic generator will change, resulting in the instability of the mechanical vibration generated by the transducer. The power amplifier is adjusted via the power feedback signal to output a signal with stable power. The oscillator is adjusted via the frequency tracking signal, so that the frequency of the output signal can track a resonant frequency point of the transducer. Moreover, the ultrasonic generator has a phase detection function and a phase adjustment function, so that ultrasonic vibrators on two different directions respectively generate ultrasonic vibration signals with a phase difference; and both of the tangential transducer and the axial transducer are piezoelectric transducers, positive and negative ions in a piezoelectric ceramic crystal generate relative displacement via the piezoelectric inverse effect of the piezoelectric transducer under the action of an electric field force, thereby generating internal stress in the crystal and causing mechanical deformation of the crystal, and thus mechanical vibration having the same frequency as an ultrasonic electrical signal is generated.

Both of the tangential amplitude change rod and the axial amplitude change rod are used for increasing the mechanical vibration generated by the transducers, a threaded hole is formed in the contact end face of the amplitude change rod and the transducer, and Vaseline oil is coated on the contact end face of the two to reduce the energy transfer loss between the transducer and the amplitude change rod, wherein shaft shoulders are arranged at positions changing from large end faces into small end faces on the amplitude change rods, so that the amplitude change rods form interference fit with bracket necks for respectively fixing a tangential ultrasonic vibrator and an axial ultrasonic vibrator to a tangential bracket and the axially adjustable bracket, and the shaft shoulders are arranged at positions changing from large end faces into small end faces on the two amplitude change rods, so that the amplitude change rods form interference fit with the bracket necks for respectively fixing the tangential ultrasonic vibrator and the axial ultrasonic vibrator to the tangential bracket and the axially adjustable bracket.

Further, a shaft shoulder neck is formed in the top of the tangential bracket, a shaft shoulder matched with the shaft shoulder neck is arranged on the circumference of the tangential amplitude change rod, so that the tangential amplitude change rod forms interference fit with the shaft shoulder neck, and a tangential bracket cover covers the shaft shoulder and is fixed with the tangential bracket;

wherein a workpiece groove used for fixing the workpiece is formed in the surface of the slide rail supporting seat, a workpiece locating stop block capable of moving axially is arranged in the workpiece groove, and a fixture bolt or screw capable of moving tangentially is arranged in the workpiece groove.

A projection is arranged on the other side of the tangential bracket fixed with the fixing plate on the tangential bracket, the axially adjustable bracket is rotatably fixed to the tangential bracket through the projection, and the axial ultrasonic vibration device is supported by the axially adjustable bracket;

further, a dial is arranged on the surrounding of the projection of the tangential bracket so as to indicate the rotation angle of the axially adjustable bracket relative to the tangential bracket;

further, the longitudinal section of the axially adjustable bracket is L-shaped; and further, the height of the axially adjustable bracket is smaller than that of the tangential bracket.

The jetting mechanism includes a nozzle, the grinding wheel is fixed in a grinding wheel cover, nozzles are respectively fixed to one or both sides of the bottom of the grinding wheel, and the nozzle is separately connected with a nanofluid conveying pipe and a compressed air conveying pipe; and further, the nanofluid conveying pipe and the compressed air conveying pipe are fixed on the side face of the grinding wheel cover through a magnetic suction cup.

The Present Invention has the Following Beneficial Effects:

The multi-angle two-dimensional ultrasonic vibration assisted nanofluid micro-lubrication grinding device provided by the present invention and the grinding force and grinding temperature measurement device thereof can be directly installed on the magnetic worktable of a precision grinding machine without reforming the processing main spindle of the precision grinding machine, thereby guaranteeing the processing precision of the machine tool and the effective transfer of the ultrasonic vibration energy. Multi-angle two-dimensional ultrasonic vibration can be achieved by the accurate adjustment of the angle between the tangential bracket and the axially adjustable bracket.

Through the change of the two-dimensional ultrasonic vibration angle, the relative movement trajectory of the abrasive particles of the grinding wheel and the workpiece also changes, so that the grinding force, the grinding temperature and the surface quality of the workpiece change. The details are as follows: firstly, the ultrasonic generator is adjusted to control the phase difference of ultrasonic electric signals on two directions, when the phase difference is $\pi/2$, the tangential ultrasonic vibration is coupled with the axial ultrasonic vibration, so that the abrasive particles of the grinding wheel and the workpiece form an elliptical relative movement trajectory, and a grinding-simulation movement trajectory is formed in combination with the feeding direction of the worktable, when the phase difference is 0 and $\pi$, the tangential ultrasonic vibration is coupled with the axial ultrasonic vibration, so that the abrasive particles of the grinding wheel and the workpiece form two groups of relative movement trajectories in which straight lines intersect with each other, and a honing-simulation movement trajectory is formed in combination with the feeding direction of the worktable; secondly, the tangential bracket and the axially adjustable bracket are adjusted to change the included angle of the ultrasonic vibration on two directions so as to further change the shape of the elliptical movement trajectory and the inclination angle of the two groups of straight lines intersecting with each other, and more dense texture veins are formed on the grinding surface of the workpiece to improve the surface quality of the workpiece; and finally, the multi-angle two-dimensional ultrasonic vibration is coupled with the nanofluid micro-lubrication, and the nanofluid can serve as a grinding material to be conveyed by a micro-lubrication system to the grinding area so as to match with the movement trajectories of grinding and honing formed by the two-dimensional ultrasonic vibration while playing cooling and lubricating functions, and thus the grinding quality is further improved.

The tangential bracket and the axially adjustable bracket of the present invention are connected to the dynamometer through the fixing plate, the position of the dynamometer is not affected when the angle of the axially adjustable bracket is adjusted, and thus the normal grinding force, the tangential grinding force and the axial grinding force can still be measured conveniently; and the grinding temperature measurement device adopts an artificial thermocouple temperature measurement method to monitor the grinding state in real time. The device realizes on-line inspection of the grinding force and the grinding temperature at the same time, thereby not only saving time, but also avoiding processing errors caused by multiple times of assembly. The grinding force and the grinding temperature are key factors for evaluating the grinding effect, and guidance is provided for the grinding processing by means of the accurate measurement of the grinding force and the grinding temperature and the analysis of the experimental data.

BRIEF DESCRIPTION OF THE DRAWINGS

FIG. 18 (*b*) is a schematic diagram of an inverse piezoelectric effect of the ultrasonic transducer in the fifth embodiment;

FIG. 20 (*b*) is a relative movement trajectory of the abrasive particles of the grinding wheel for grinding the workpiece in two-dimensional ultrasonic vibration;

FIG. 20 (*c*) is a relative movement trajectory of the abrasive particles of the grinding wheel for honing the workpiece in two-dimensional ultrasonic vibration;

FIG. 20 (*d*) is a relative movement trajectory of the abrasive particles of the grinding wheel and the workpiece in one-dimensional tangential ultrasonic vibration;

FIG. 20 (*e*) is a relative movement trajectory of the abrasive particles of the grinding wheel and the workpiece in one-dimensional axial ultrasonic vibration;

DETAILED DESCRIPTION OF THE EMBODIMENTS

Figure 19:
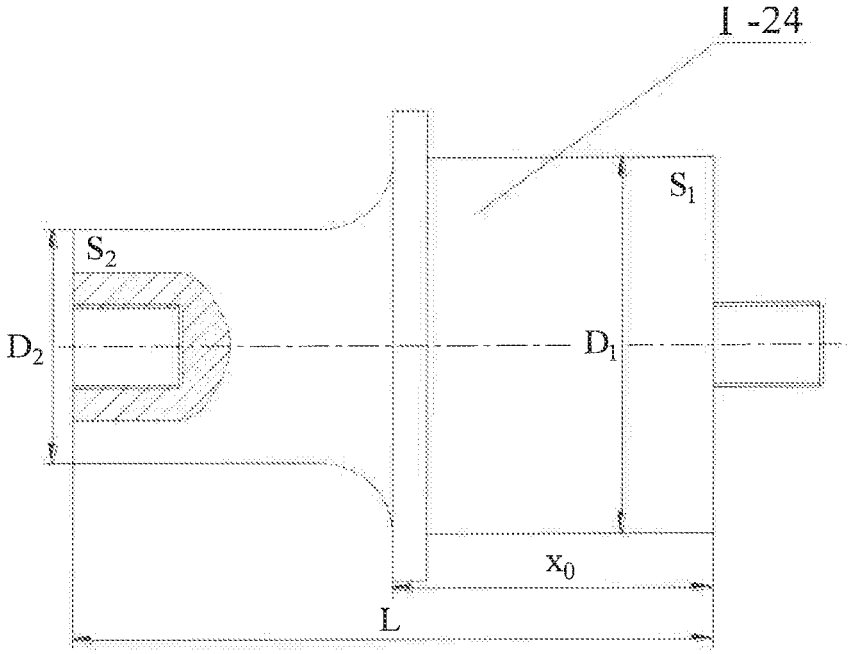
FIG. 19 is a structural schematic diagram of an amplitude change rod in the fifth embodiment.
Figure 20:
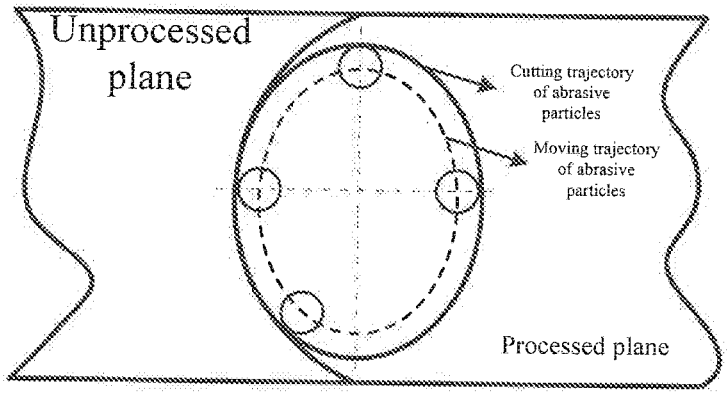
FIG. 20 (*a*) is a relative movement trajectory of abrasive particles of a grinding wheel and a workpiece in two-dimensional ultrasonic vibration.
Figure 20:
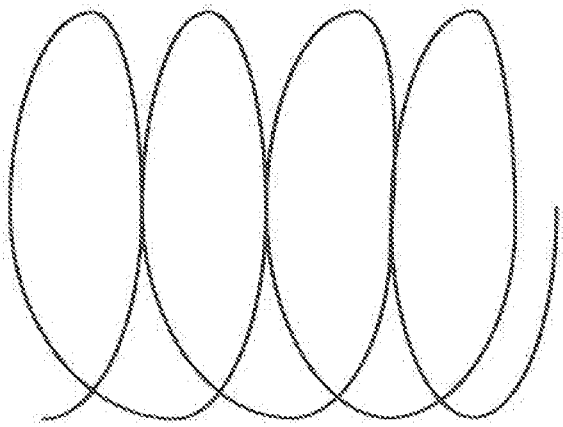
Figure 20:
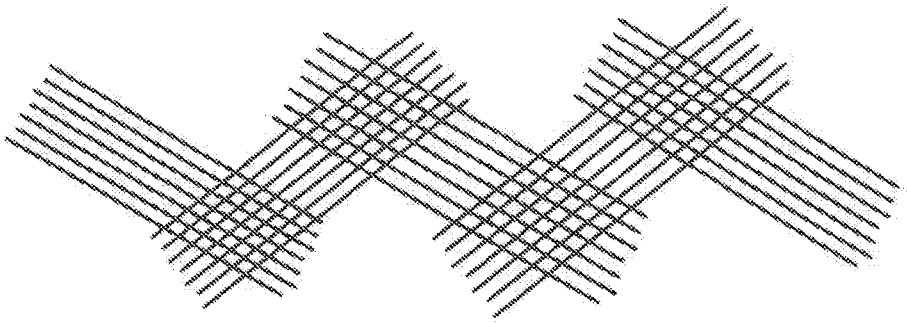
Figure 20:
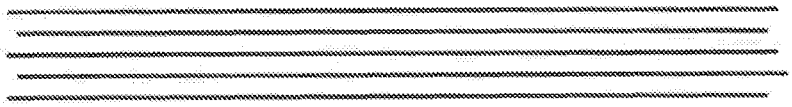
Figure 20:
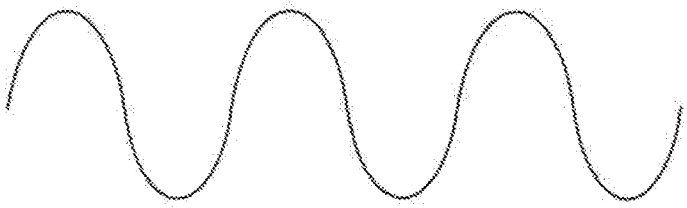
Figure 21:
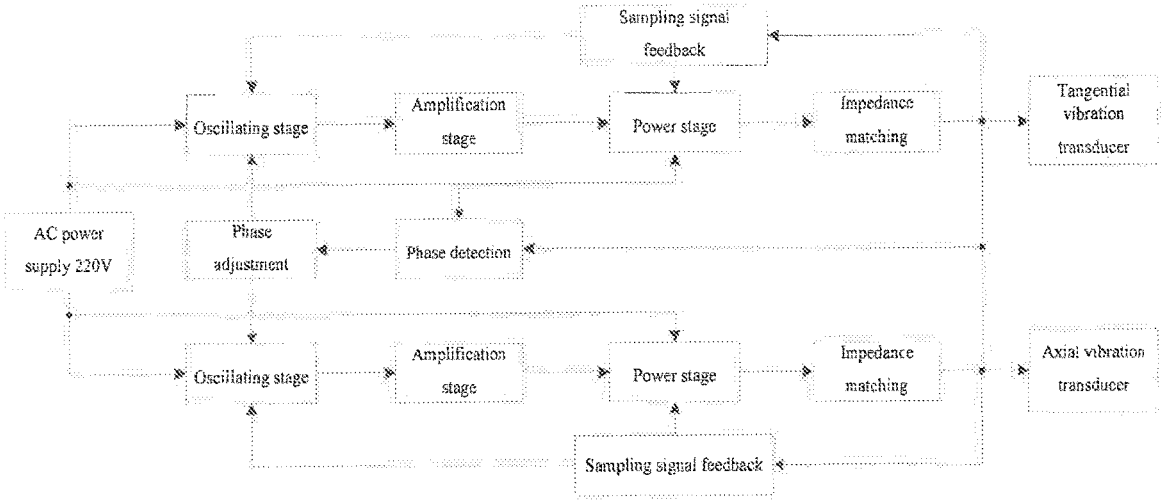
FIG. 21 is a control chart of an ultrasonic generator in the fifth embodiment; wherein, I-1—axial negative electrode copper sheet, I-2—axial transducer, I-3—axial amplitude change rod, I-4—axially adjustable bracket cover screw, I-5—axially adjustable bracket cover, I-6—fixing plate, I-7—axial supporting seat, I-8—slide rail supporting seat, I-9—workpiece fixture, I-10—fixture screw, I-11—tangential workpiece locating screw, I-12—workpiece, I-13—workpiece locating stop block, I-14—axial workpiece locating screw, I-15—locating screw, I-16—oil jack shell, I-17— universal joint ball core, I-18—universal joint nut, I-19—universal joint ball shell, I-20—jack locating screw, I-21—tangential bracket cover, I-22—tangential bracket cover screw, I-23—dial, I-24—tangential amplitude change rod, I-25—tangential transducer, I-26—tangential positive electrode copper sheet, I-27—tangential negative electrode copper sheet, I-28—tangential bracket, I-29—tangential bracket locating screw, I-30—fixing plate locating screw, I-31—axially adjustable bracket locating nut, I-32—axially adjustable bracket locating bolt, I-33—axially adjustable bracket, I-34—axial positive electrode copper sheet, I-35—jack rolling ball, I-36—T-shaped slide block, I-37—slide block rolling ball, I-38—T-shaped chute, I-39—shaft shoulder neck, I-40—amplitude change rod shaft shoulder, I-41—boss threaded hole, I-42—tangential bracket boss, I-43—jack rolling ball locating screw, I-44—lifting sleeve, I-45—oil inlet and outlet, I-46—piezoelectric ceramic, I-47—piezoelectric ceramic locating screw, II-1—grinding wheel cover, II-2—magnetic suction cup, II-3—grinding wheel, II-4—nanofluid conveying pipe, II-5—compressed air conveying pipe, II-6—nozzle, II-7—magnetic worktable, III-1—grinding force control system, III-2—grinding force information collector, III-3—amplifier, III-4—dynamometer, III-5—thermocouple, III-6—grinding temperature information collector, III-7—low pass filter, III-8—grinding temperature control system, III-9—ultrasonic generator, III-10—negative electrode conducting wire, and III-11—positive electrode conducting wire.

The present invention will be further described below in combination with specific embodiments and the drawings:

The first embodiment of the present invention is as shown in FIG. 1 to FIG. 4, FIG. 7 to FIG. 19, FIG. 20 (*a*) to FIG. 20 (*c*) and FIG. 21, and relates to a multi-angle two-dimensional ultrasonic vibration assisted nanofluid micro-lubrication grinding device in which a tangential direction parallel to the grinding direction and an axial direction vertical to the grinding direction are coupled, and a grinding force and grinding temperature measurement device thereof.

Figure 1:
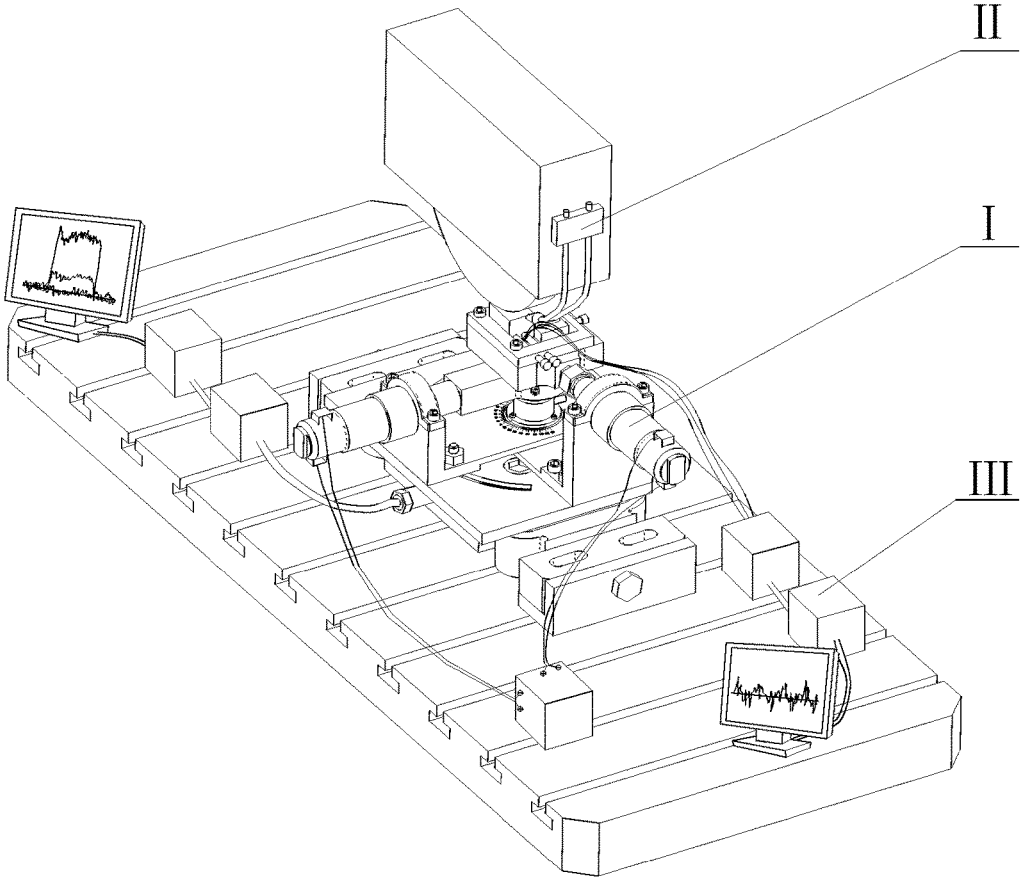
FIG. 1 is an axonometrical drawing of a multi-angle two-dimensional ultrasonic vibration assisted nanofluid micro-lubrication grinding device.

As shown in FIG. 1, the multi-angle two-dimensional ultrasonic vibration assisted nanofluid micro-lubrication grinding device, and the grinding force and grinding temperature measurement device thereof are formed by three parts, namely, a multi-angle two-dimensional ultrasonic vibration device I, a nanofluid micro-lubrication grinding device II and a grinding force and grinding temperature measurement device III.

Figure 2:
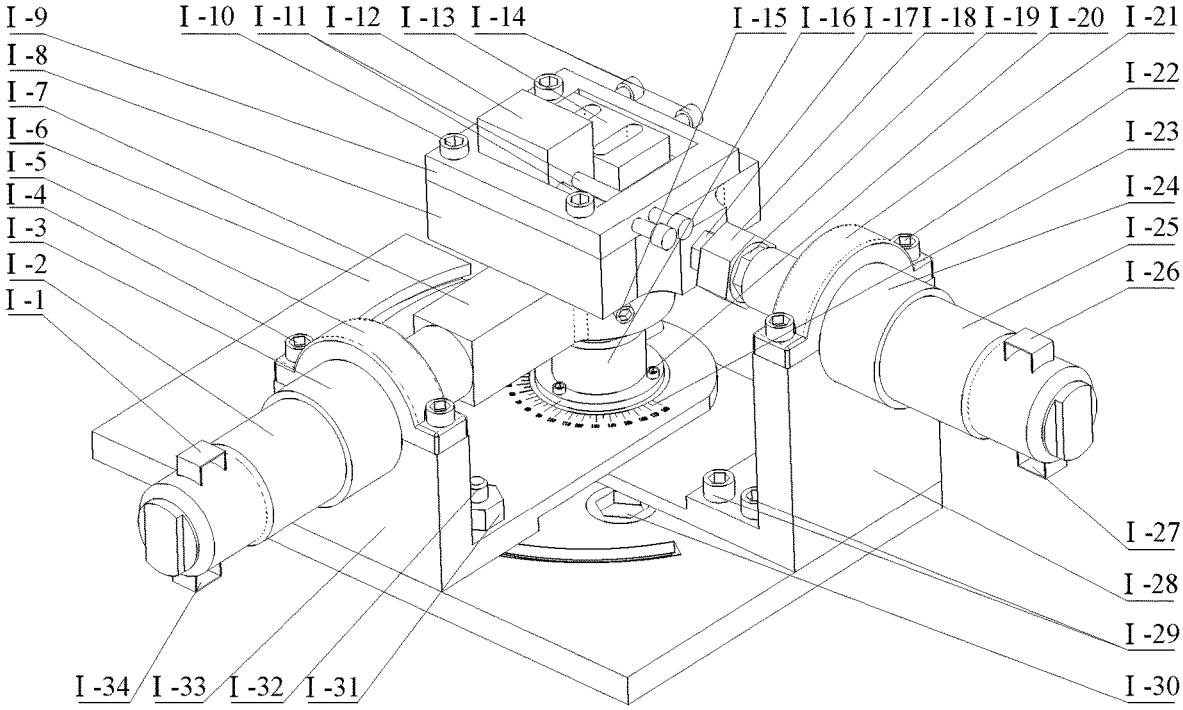
FIG. 2 is an axonometrical drawing of a first part, namely a multi-angle two-dimensional ultrasonic vibration device in first, second and third embodiments.

As shown in FIG. 2, a tangential bracket I-28 and an axially adjustable bracket I-33 are respectively located and clamped on a fixing plate I-6 through a tangential bracket locating screw I-29, an axially adjustable bracket locating bolt I-32 and an axially adjustable bracket locating nut I-31; a tangential bracket boss I-42 serves as a rotation center of the axially adjustable bracket I-33, and in order to achieve accurate locating, a dial I-23 is arranged on a part matching with the tangential bracket boss I-42 on the bottom of the axially adjustable bracket I-33; three threaded holes arranged to form a 120° angle on the circumference are formed in the tangential bracket boss I-42, an oil jack shell I-16 and a tangential bracket I-28 are connected in a locating manner through three jack locating screws I-20; a tangential amplitude change rod I-24 and an axial amplitude change rod I-3 are respectively fixed to the tangential bracket I-28 and the axially adjustable bracket I-33 through a tangential bracket cover I-21 and an axially adjustable bracket cover I-5; the tangential amplitude change rod I-24 is connected with a slide rail supporting seat I-8 through a universal ball joint, a universal joint ball core I-17 is in threaded connection with the slide rail supporting seat I-8, a universal joint ball shell I-19 is in threaded connection with the tangential amplitude change rod I-24, and threads are arranged on the outer layer of the universal joint ball shell I-19 so as to be connected with the universal joint ball core I-17 through a universal joint nut I-18; and a workpiece fixture I-9 is fixed on the slide rail supporting seat I-8 through three fixture screws that are arranged in an L shape.

Figure 3:
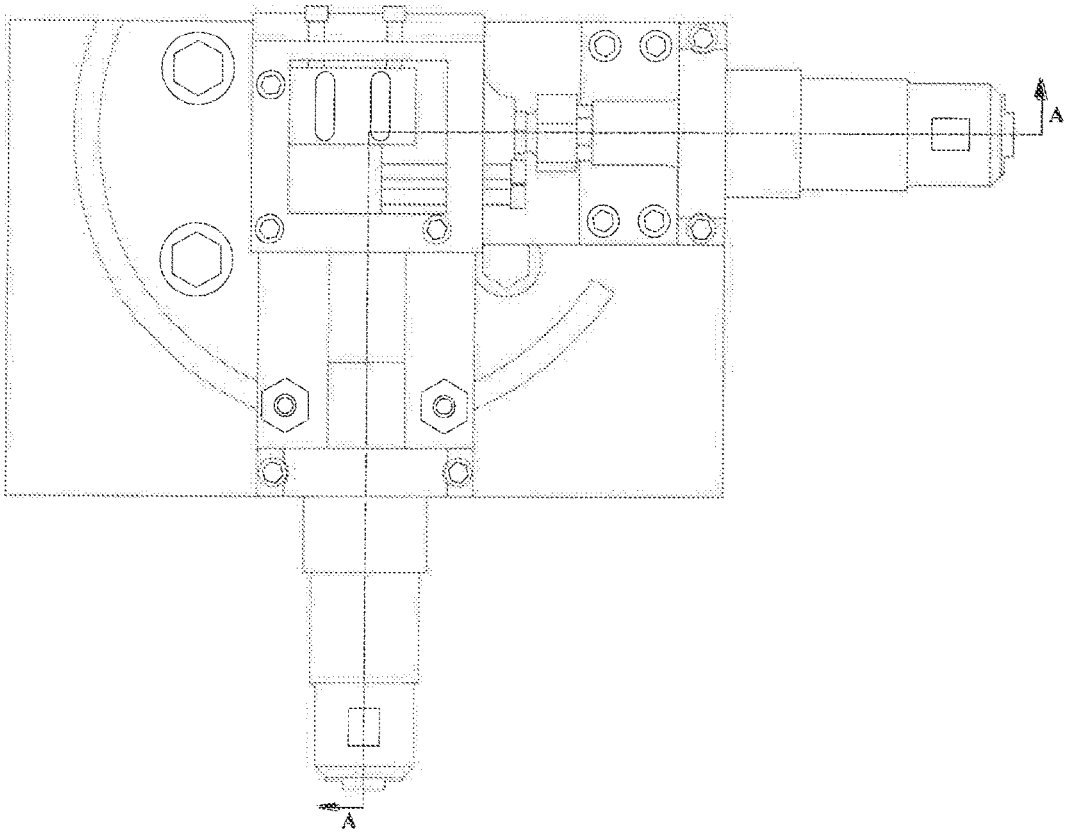
FIG. 3 is a top view of the first, second and third embodiments.
Figure 4:
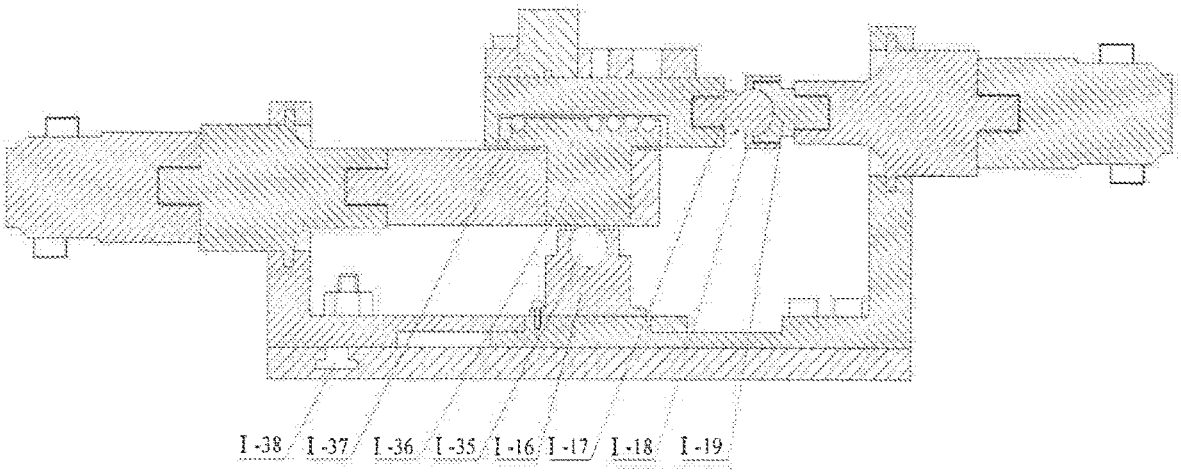
FIG. 4 is a rotation section view of A-A in FIG. 3.
Figure 5:
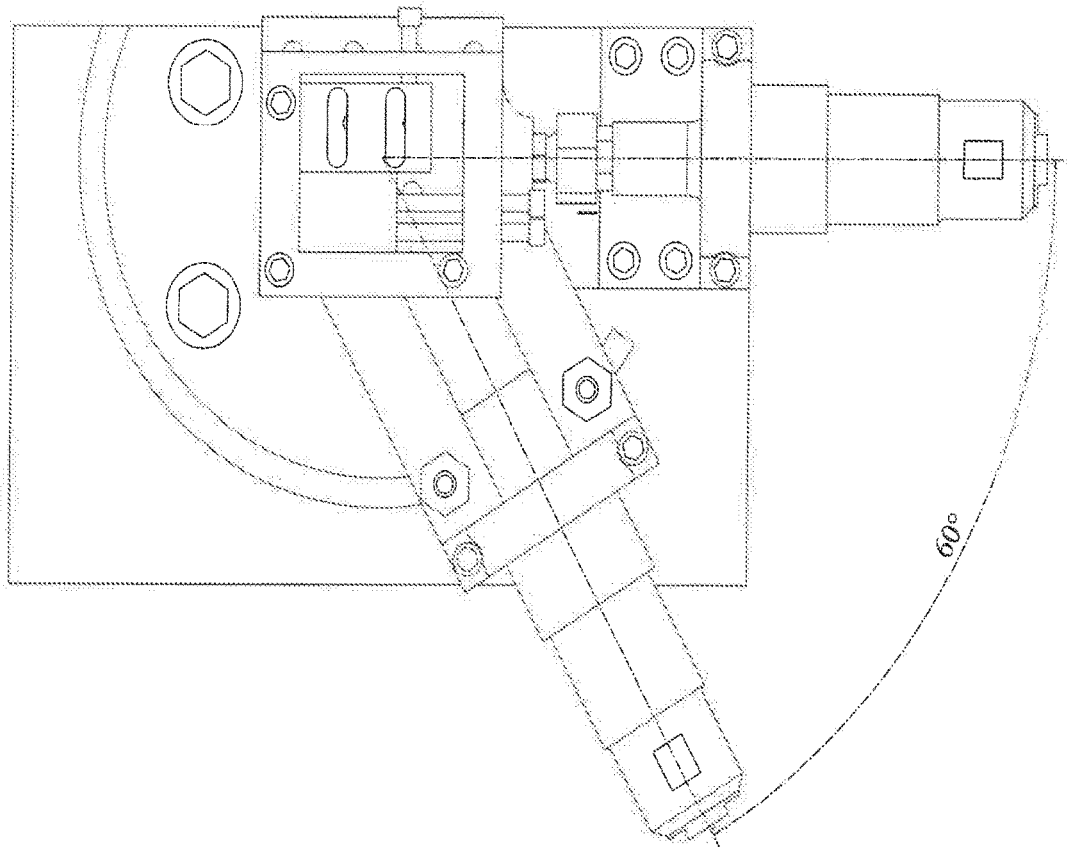
FIG. 5 is a top view of a fourth embodiment.
Figure 6:
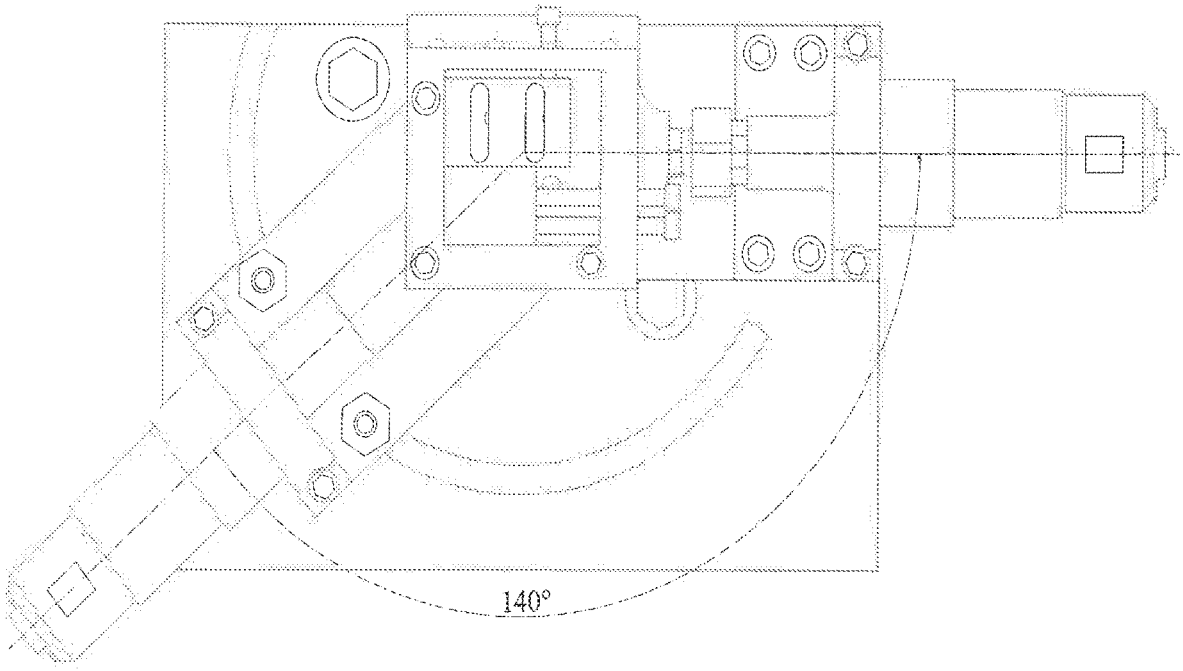
FIG. 6 is a top view of a fifth embodiment.

As shown in FIG. 3 and FIG. 4, the mounting manner of the first embodiment can be seen more intuitively, the included angle between a tangential ultrasonic vibrator and an axial ultrasonic vibrator mounted on a fixing plate I-6 is 90°, in order to improve the stability of the entire ultrasonic system, an oil jack is mounted below a slide block I-36, the oil jack is in contact with a bottom surface of a T-shaped slide block I-36 through a jack rolling ball I-35 for supporting, and when the stability is improved, the energy consumed by the friction between the bottom surface of the T-shaped slide block and the oil jack can be effectively reduced; a chute I-38 is formed in the fixing plate I-6 for constraining the movement trajectory of the axially adjustable bracket I-33, the axially adjustable bracket locating bolt I-32 is mounted in the chute for fixing the axially adjustable bracket I-33 to the fixing plate I-6 while facilitating the adjustment of the axially adjustable bracket I-33; the T-shaped slide block I-36 forms interference fit with the slide rail supporting seat I-8 through slide block rolling balls I-37 on the upper top face and the two sides, due to this arrangement manner maximally, the friction between the slide rail supporting seat I-8 and the T-shaped slide block I-36 is reduced on one hand, and the stability of the slide rail supporting seat I-8 can be ensured on the other hand, and as the interference fit is adopted, the situation that the local impact is produced to generate impact damage to the T-shaped slide block I-36 and the slide rail supporting seat I-8.

Figure 7:
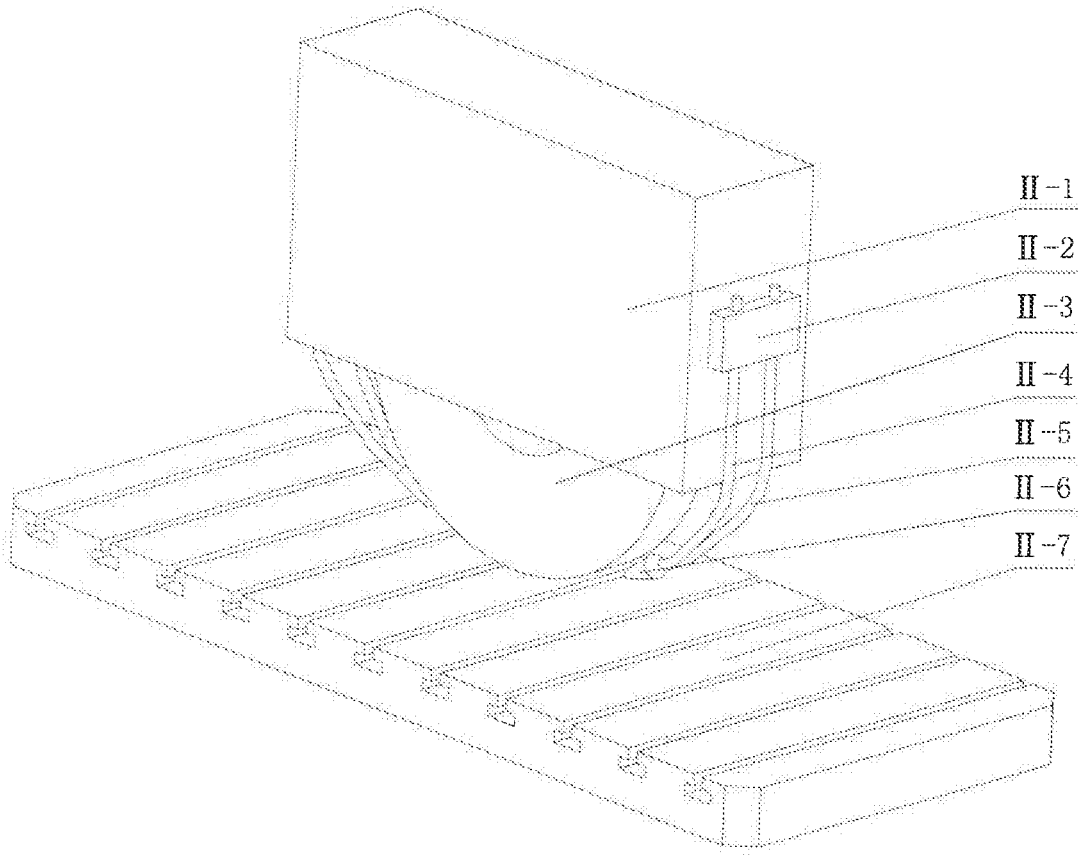
FIG. 7 is an axonometrical drawing of a second part, namely the nanofluid micro-lubrication grinding device.

As shown in FIG. 7, the nanofluid micro-lubrication grinding device includes a grinding wheel cover II-1, magnetic suction cups II-2, a grinding wheel I-3, a nanofluid conveying pipe II-4, a compressed air conveying pipe II-5, a nozzle II-6 and a magnetic worktable II-7, wherein two sides of the grinding wheel cover II-1 are each provided with a magnetic suction cup II-2 for fixing the nanofluid conveying pipe II-4 and the compressed air conveying pipe II-5; the nanofluid conveying pipe II-4 and the compressed air conveying pipe II-5 join at the nozzle II-6, so that nanofluid and compressed air are fully mixed in the inner cavity of the nozzle II-6 to form aerial fog, and the aerial fog is jetted to an interface of the grinding wheel II-3 and a workpiece I-12 for lubricating and cooling.

Figure 8:
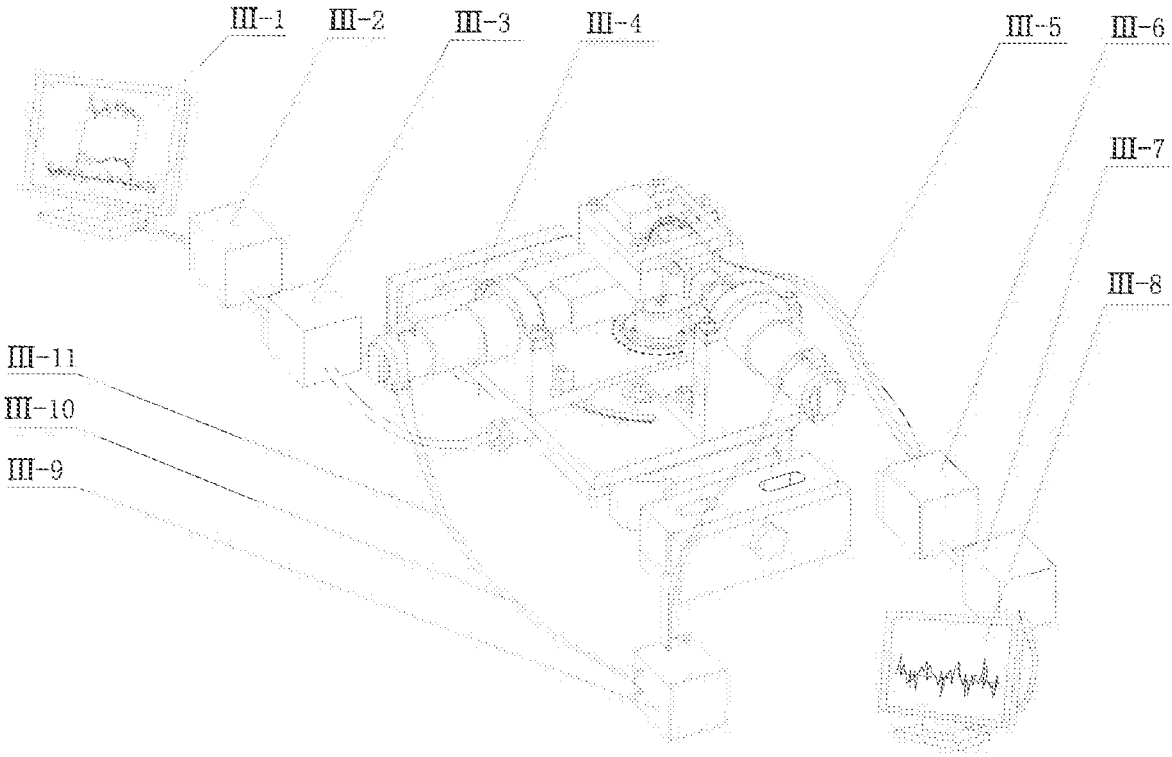
FIG. 8 is an axonometrical drawing of a third part, namely an online grinding force and grinding temperature measurement device.

As shown in FIG. 8, a dynamometer III-4 is connected with a multi-degree of freedom two-dimensional ultrasonic vibration device through the fixing plate I-6, and the dynamometer III-4 is adsorbed and fixed to the magnetic worktable II-7 through a magnetic force; the grinding force measurement device includes a grinding force control system III-1, a grinding force information collector III-2, an amplifier III-3 and the dynamometer III-4, when the workpiece I-12 is subjected to a grinding force, a measurement signal is amplified by the amplifier III-3 and is transferred to the grinding force information collector III-2 and is finally transferred to the grinding force control system III-1, and the size of the grinding force is displayed; the grinding temperature measurement device includes a thermocouple III-5, a grinding temperature information collector III-6, a low pass filter III-7 and a grinding temperature control system III-8, the measurement signal is transferred by the thermocouple III-5 to the grinding temperature information collector III-6 and then is transferred to the low pass filter III-7, some interference signals are filtered, the measurement signal is finally transferred to the grinding temperature control system III-8, and the working temperature of the thermocouple III-5, namely the temperature of the workpiece I-12 is displayed. An ultrasonic generator III-9 provides ultrasonic frequency electric signals for a tangential transducer I-25 and an axial transducer I-2, the ultrasonic frequency electric signals are transferred to an axial positive electrode copper sheet I-34 and an axial negative electrode copper sheet I-1 by a positive electrode conducting wire III-11 and a negative electrode conducting wire III-10.

Figure 9:
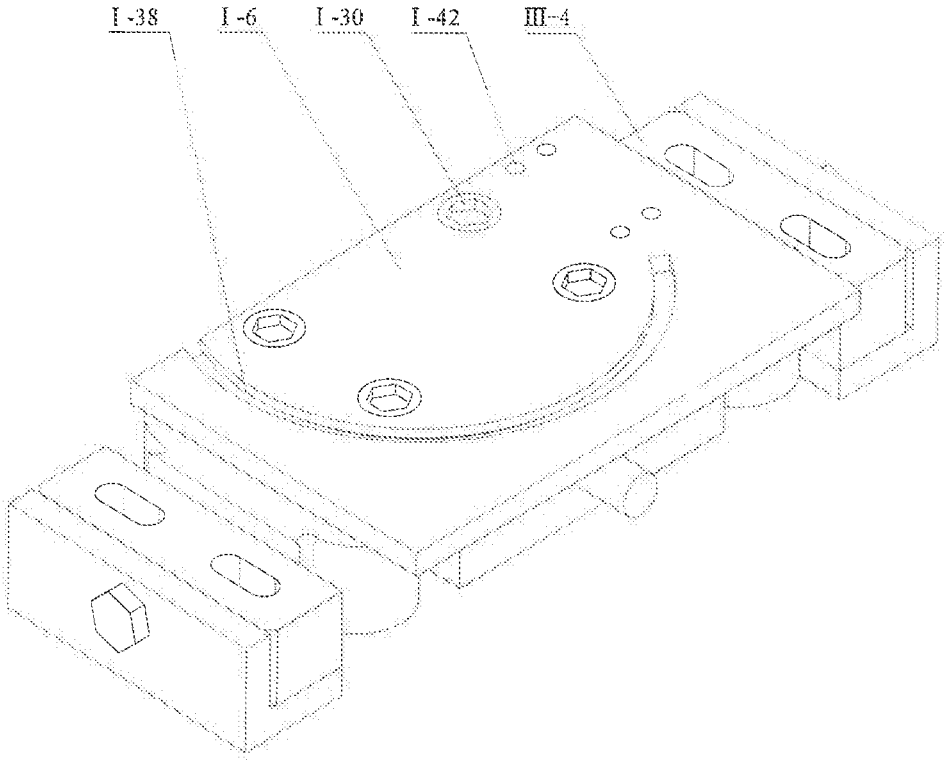
FIG. 9 is a mounting and locating schematic diagram of a fixing plate and a dynamometer in the fifth embodiment.

As shown in FIG. 9, the dynamometer III-4 is connected with the fixing plate I-6 through four fixing plate locating screws I-30, the stability of the fixing plate I-6 directly affects the stability of the whole two-dimensional ultrasonic vibration system, therefore the spans of the four fixing plate locating screws I-30 are as large as possible, and in order not to hinder the rotation of the axially adjustable bracket I-33 and the mounting of the tangential bracket I-28, the top faces of the fixing plate locating screws I-30 should be flush with the upper bottom surface of the fixing plate I-6.

Figure 10:
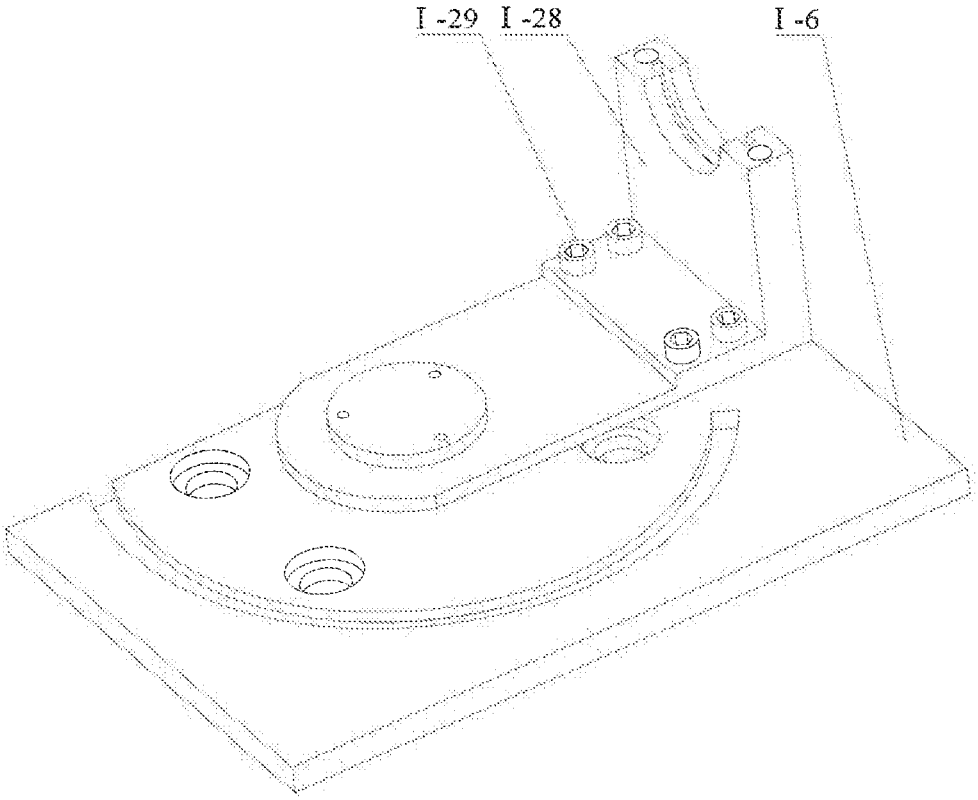
FIG. 10 is a mounting and locating schematic diagram of a tangential bracket and the fixing plate in the fifth embodiment.

As shown in FIG. 10, the tangential bracket I-28 is fixed to the fixing plate I-6 through four tangential bracket locating screws I-29; the chute I-38 does not extend to the bottom of the tangential bracket I-28, this is because both of the tangential bracket I-28 and the axially adjustable bracket I-33 have certain widths and certain limitations; and considering the rigidity of the fixing plate I-6 and the stability of the axially adjustable bracket I-33, the chute I-38 is not designed to be hollow.

Figure 11:
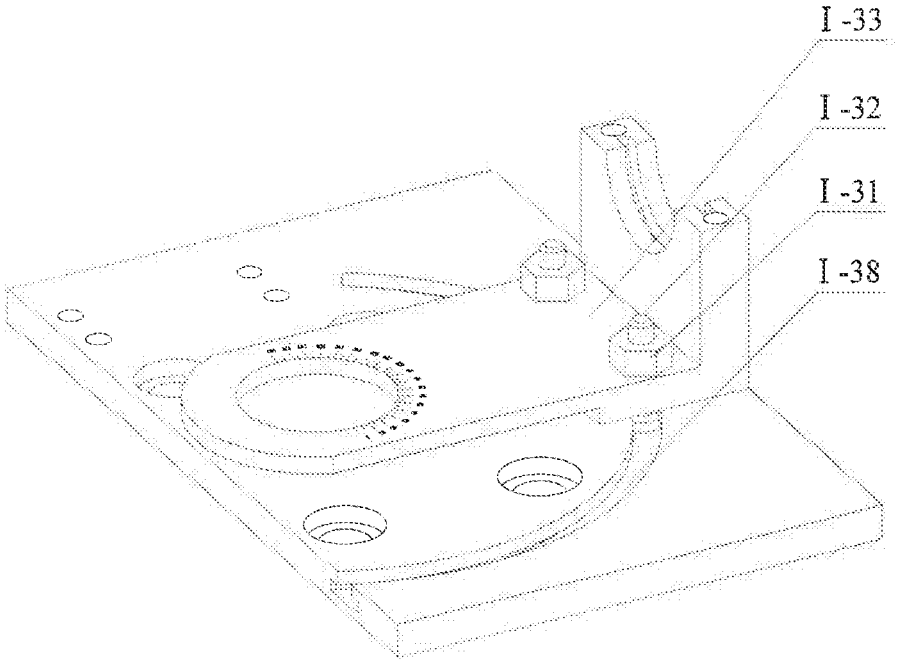
FIG. 11 is a mounting and locating schematic diagram of an axially adjustable bracket and the fixing plate in the fifth embodiment.

As shown in FIG. 11, the axially adjustable bracket I-33 is located and clamped with the fixing plate I-6 through two groups of axially adjustable bracket locating bolts I-32 and axially adjustable bracket locating nuts I-31; and the two groups of axially adjustable bracket locating bolts I-32 are embedded in the chute I-38 and move along a movement trajectory constrained by the chute I-38.

Figure 12:
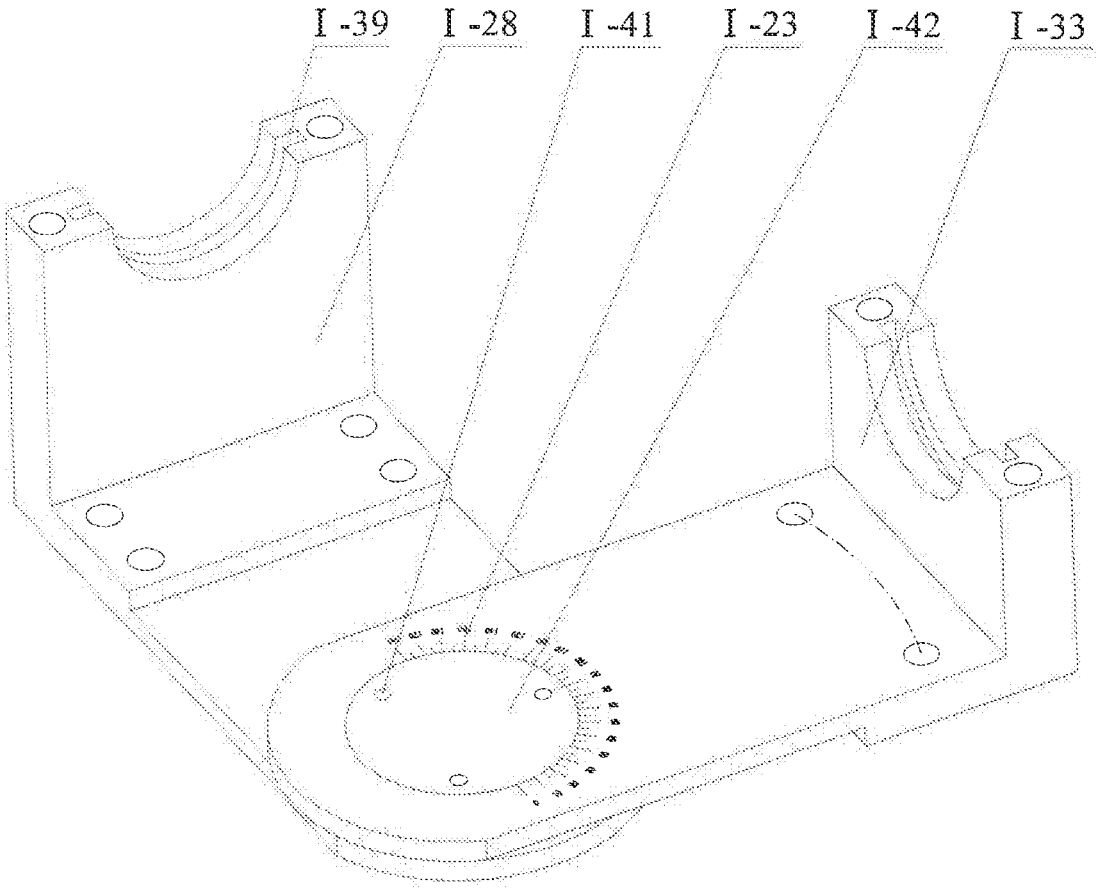
FIG. 12 is an assembly schematic diagram of the axially adjustable bracket and the tangential bracket in the fifth embodiment.

As shown in FIG. 12, the axially adjustable bracket I-33 is matched with the tangential bracket through the tangential bracket boss I-42 on the tangential bracket I-28; the scale lines on the tangential bracket boss I-42 can accurately indicate the angle of the dial I-23 on the axially adjustable bracket I-33 so as to accomplish accurate angle adjustment, at this time, in the first embodiment, with respect to the position relation between the axially adjustable bracket I-33 and the tangential bracket I-28, the scale line indicates 90°; three boss threaded holes I-41 forming a 120° angle on the tangential bracket boss I-42 are matched with the threaded holes in the oil jack shell I-16 and are fixed by the jack locating screws I-20.

Figure 13:
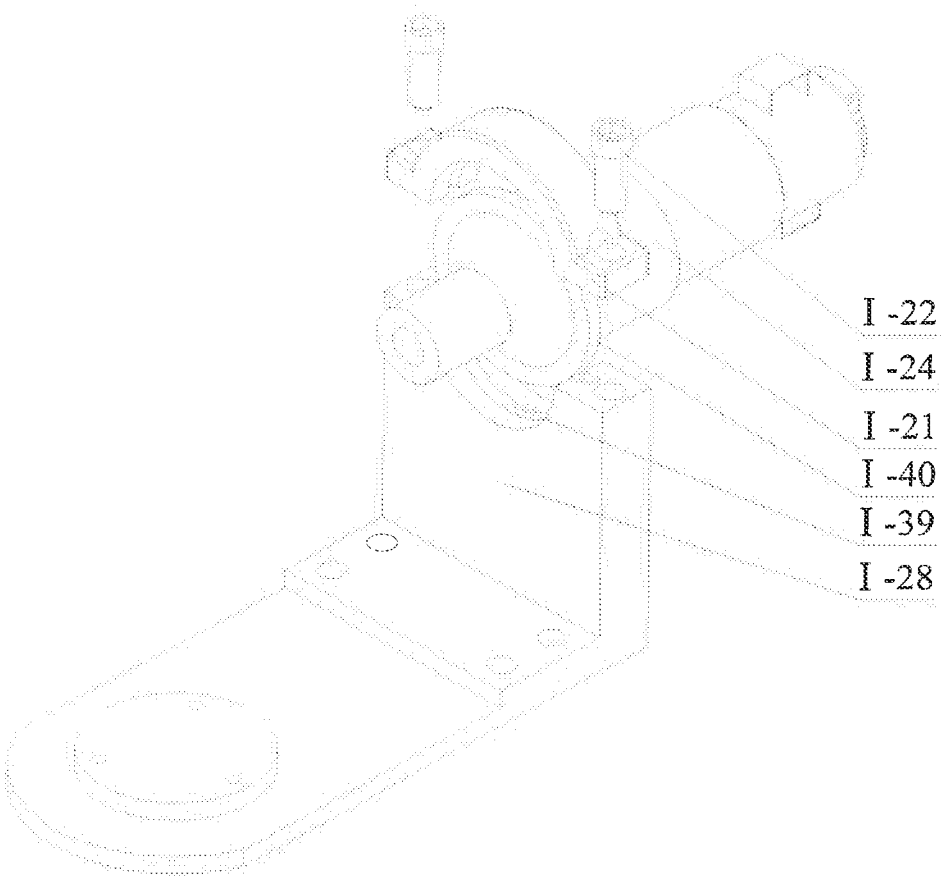
FIG. 13 is a mounting and locating schematic diagram of a tangential ultrasonic vibrator and the tangential bracket in the fifth embodiment.

As shown in FIG. 13, it is the mounting manner of the tangential ultrasonic vibrator and the tangential bracket I-28, the tangential ultrasonic vibrator is fixed to the tangential bracket I-28 by the tangential bracket cover I-21, the tangential bracket cover I-21 is fixed with the tangential bracket I-28 by two tangential bracket cover screws I-22; meanwhile, the tangential amplitude change rod I-24 is provided with a shaft shoulder I-40 to be matched and fixed with the shaft shoulder neck formed in the tangential bracket I-28; and the mounting manner of the axial ultrasonic vibrator and the axially adjustable bracket I-33 is the same as the mounting manner of the tangential ultrasonic vibrator and the tangential bracket I-28.

Figure 14:
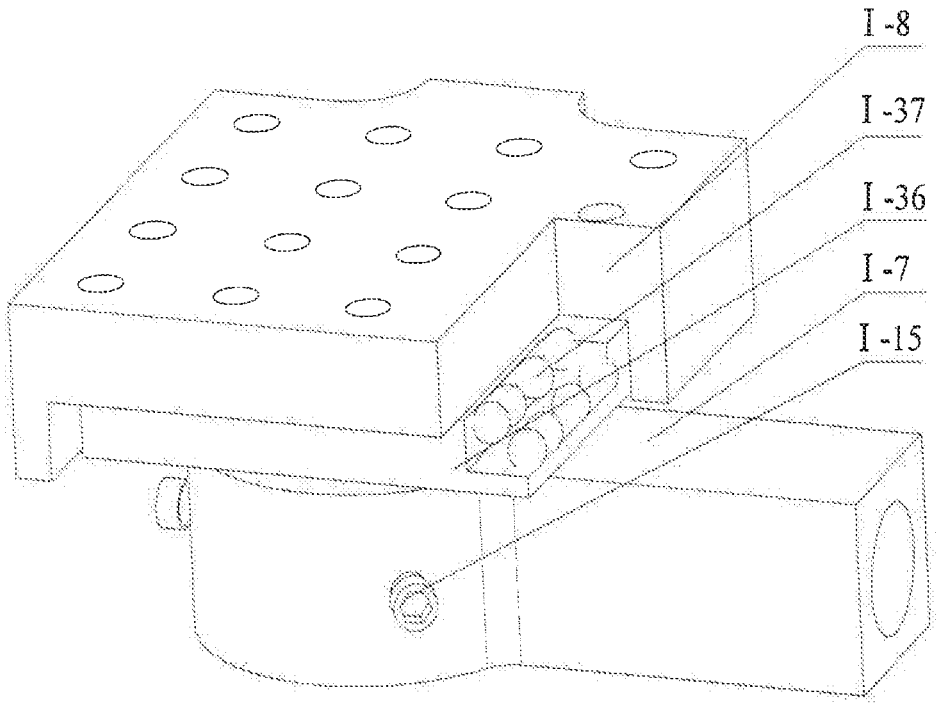
FIG. 14 is an assembly structure diagram of a slide rail supporting seat, a slide block and an axial supporting seat in the fifth embodiment.

As shown in FIG. 14, the supporting seat contains three parts in total, which are respectively the slide rail supporting seat I-8, the T-shaped slide block I-36 and an axial supporting seat I-7; in order that the axial supporting seat I-7 can be conveniently rotated to be clamped and located with the T-shaped slide block I-36 through three locating screws I-15 forming a 120° angle, the T-shaped slide block I-36 is in contact fit with the slide rail supporting seat I-8 through the slide block rolling balls I-37; and in order to ensure the stability of the slide rail supporting seat I-8, the mounting between the axial supporting seat I-7 and the T-shaped slide block I-36 is crucially important, and thus when the two parts are mounted, it should be ensured that the locating screws I-15 are tightly screwed.

Figure 15:
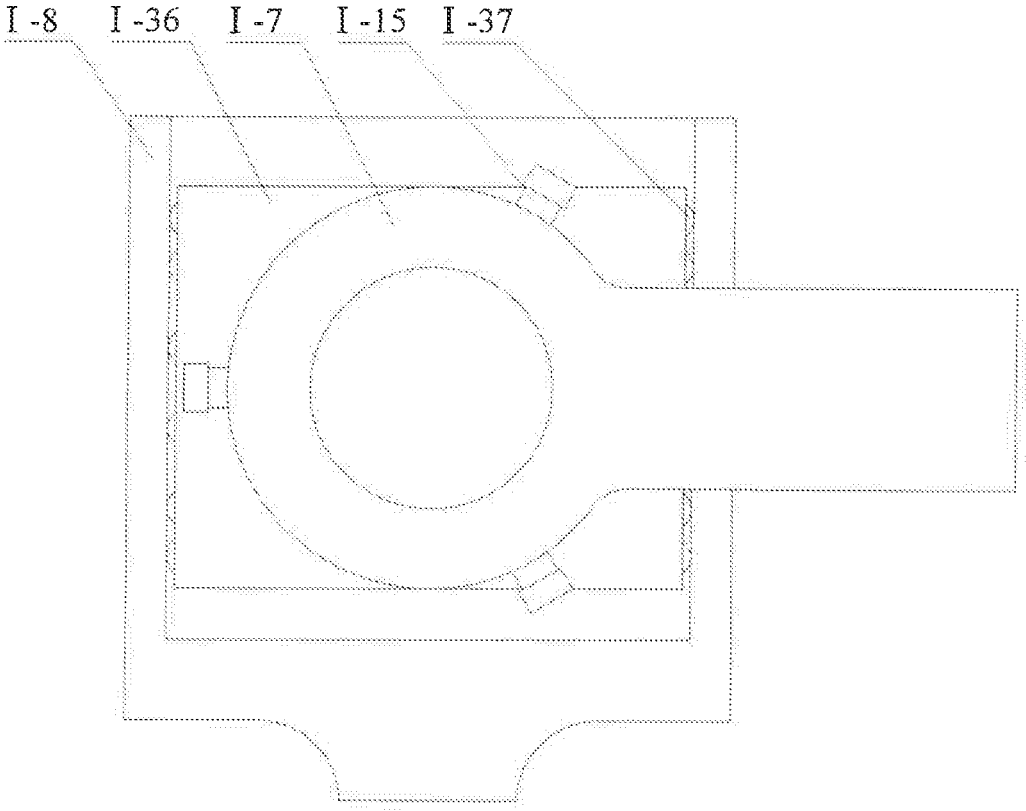
FIG. 15 is a vertical view of FIG. 14.

As shown in FIG. 15, the assembly position relationship among the slide rail supporting seat I-8, the T-shaped slide block I-36 and the axial supporting seat I-7 can be clearly seen from the vertical view of the supporting seat, wherein a row of slide block rolling balls I-37 is respectively arranged on the two sides of the T-shaped slide block I-36 to contact two inner side faces of the slide rail supporting seat I-8 so as to reduce the friction; the T-shaped slide block I-36 and the slide rail supporting seat I-8 generate tangential displacement movement, which is determined by certain amplitude generated by the slide rail supporting seat I-8, therefore there is a certain gap between the T-shaped slide block I-36 and the slide rail supporting seat I-8 along the tangential direction so as to provide a displacement space for the slide rail supporting seat I-8.

Figure 16:
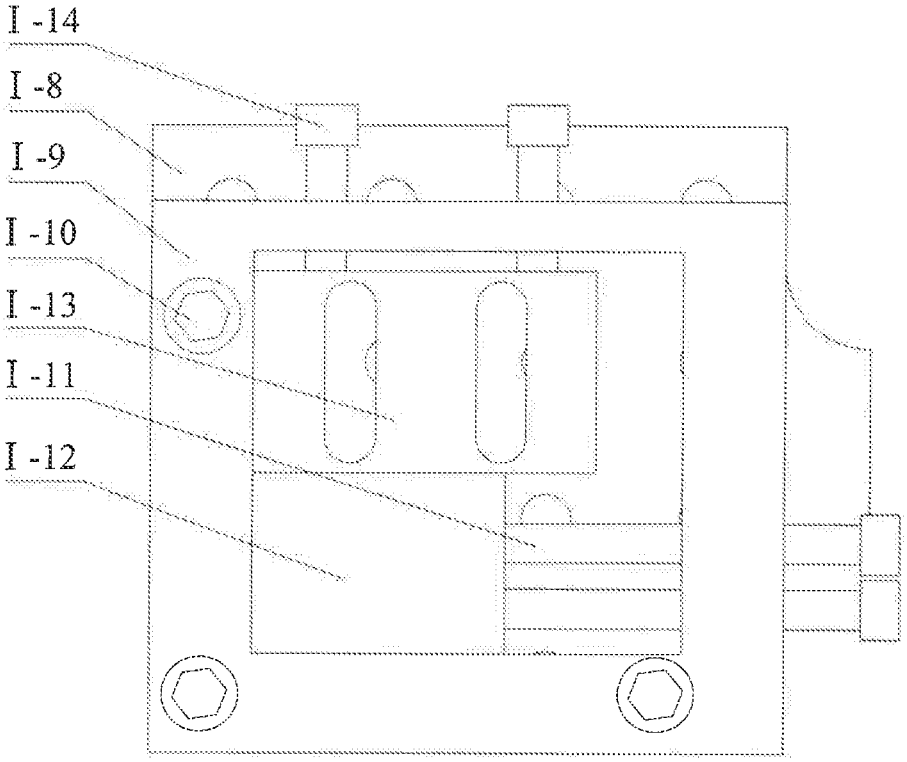
FIG. 16 is a structural schematic diagram of a workpiece locating and clamping device.

As shown in FIG. 16, the workpiece fixture I-9 on the slide rail supporting seat I-8 is located and clamped by three fixture screws I-10 arranged in an L shape; the axial direction of the workpiece I-12 is located and clamped by a workpiece locating stop block I-13 and two axial locating screws I-14; the tangential direction of the workpiece is located and clamped by two tangential locating screws I-11; the reason why the workpiece locating stop block I-13 is used is that the workpiece I-12 is inconsistent in size, the workpiece I-12 is hard to be kept stably just by the two axial locating screws I-14, and thus the workpiece locating stop block I-13 can realize the stable mounting of the workpiece I-12.

Figure 17:
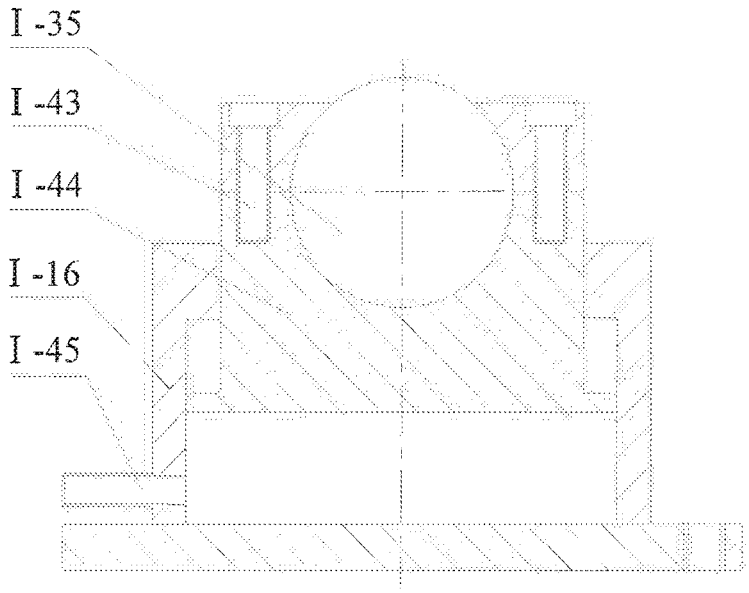
FIG. 17 is a section view of an oil jack in the fifth embodiment.

As shown in FIG. 17, the oil jack includes a jack rolling ball I-35, an oil jack shell I-16 and a lifting sleeve I-44, wherein the jack rolling ball I-35 is fixed to the top end of the lifting sleeve I-44 by four jack rolling ball locating screws I-43; a sealing ring is arranged in a contact area of the lifting sleeve I-44 and the inner cavity of the oil jack shell I-16 to prevent the leakage of hydraulic oil; and an oil inlet and outlet I-45 is formed in the bottom of the oil jack shell I-16, and the hydraulic oil is pumped into the oil jack shell I-16 by external oil pumping equipment via the oil inlet and outlet I-45 so as to achieve the up and down movement of the lifting sleeve I-44.

Figure 18:
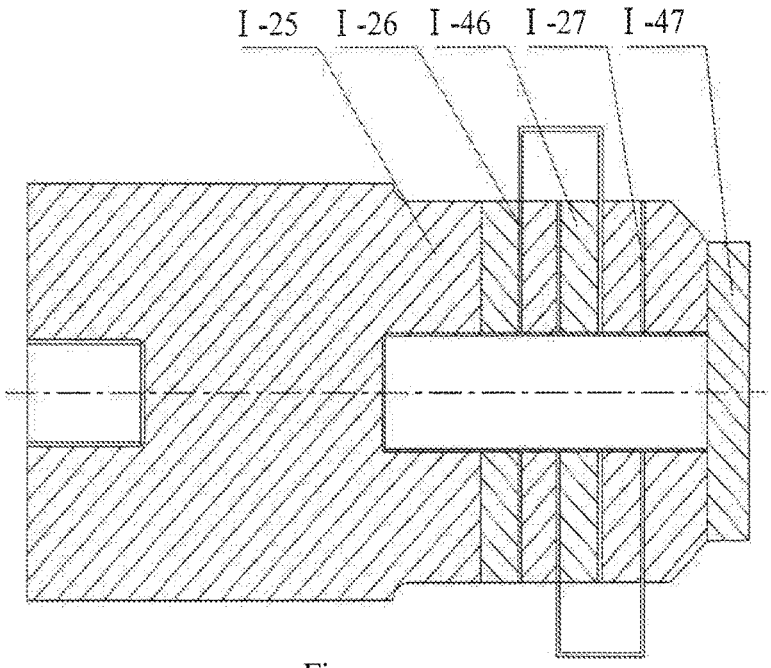
FIG. 18 (*a*) is a section view of an ultrasonic transducer in the fifth embodiment.
Figure 18:
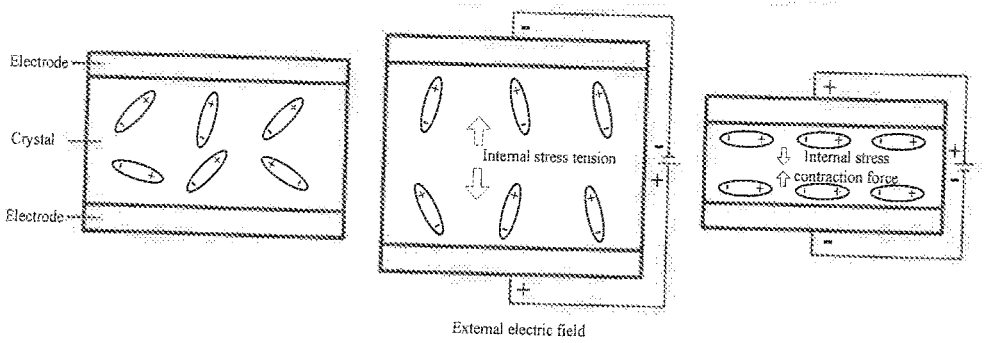

As shown in FIG. 18 (*a*) and FIG. 18 (*b*), four piezoelectric ceramic pieces I-46 are arranged in the tangential transducer I-25 and are connected and fixed with the tangential transducer I-25 through piezoelectric ceramic locating screws I-47; a tangential positive electrode copper sheet I-26 and a tangential negative electrode copper sheet I-27 are arranged among the four piezoelectric ceramic pieces I-46 in a crossing manner; the tangential transducer I-25 converts the ultrasonic frequency electric signals generated by the ultrasonic generator III-9 into mechanical vibration through the piezoelectric inverse effect of the piezoelectric ceramic I-46, when a certain number of charges are applied to the surface of the crystal of the piezoelectric ceramic I-46, the crystal generates deformation, which is the piezoelectric inverse effect, positive and negative ions in the crystal generate relative displacement under the action of an electric field force, so that internal stress is generated in the crystal, which causes mechanical deformation of the crystal; and the internal mounting manner and the working principle of the axial transducer I-2 are the same as those of the tangential transducer I-25.

As shown in FIG. 19, the reason why the tangential amplitude change rod I-25 can amplify the amplitude of the ultrasonic vibration is that the vibration energy passing any section is invariable, so that the energy density is large on a place with a small section. The energy density is proportional to the amplitude $A^2$, if the energy density is larger on the place with the small section, the amplitude is also larger, that is, the amplitude on the place with the small section of the amplitude change rod is amplified. The working principle of the axial amplitude change rod I-3 is the same as that of the tangential amplitude change rod I-25.

The computational formula of a resonance length L is:

$$L = \frac{\lambda}{2} \tag{1}$$

In the formula, L represents the resonance length, and λ represents an ultrasonic wavelength, which can be calculated by the following formula:

$$\lambda = \frac{c}{f} \tag{2}$$

In the formula, c represents the transmission speed of the ultrasonic wave in a medium, f represents the ultrasonic vibration frequency, considering the economical cost and the experiment conditions, 45# steel is used as the material of the amplitude change rod, the transmission speed of the ultrasonic wave in the 45# steel is c=5170 m/s, the frequency f=20 KHz, and the resonance length L=129.25 mm is obtained by the calculated ultrasonic wavelength λ=258.5 mm.

A displacement node computational formula is:

$$x_0 = \frac{\lambda}{4} \tag{3}$$

a displacement node $x_0$=64.625 mm.

An amplification coefficient computational formula is:

$$M_P = N^2 \tag{4}$$

$$N = \frac{S_1}{S_2} \tag{5}$$

In the formula, Mp represents an amplification coefficient, N represents an area coefficient, $S_{1,2}$ represents input and output end areas (mm2) of the amplitude change rod, and $D_{1,2}$ represents the diameters (mm) of an input end and an output end of the amplitude change rod in FIG. 19. The diameters of the input end and the output end are set according to the necessary amplification coefficient of the amplitude change rod.

As shown in FIG. 20 (*a*) to FIG. 20 (*c*), there are two relative movement trajectories between the abrasive particles of the two-dimensional ultrasonic vibration assisted nanofluid micro-lubrication grinding wheel and the workpiece parallel to the grinding direction and vertical to the grinding direction, which are respectively a grinding-simulation movement trajectory and a honing-simulation movement trajectory; the two relative movement trajectories are produced by a phase adjustment link in the ultrasonic generator, when the phase difference is π/2, the tangential ultrasonic vibration is coupled with axial ultrasonic vibration, so that the abrasive particles of the grinding wheel and the workpiece form an elliptical relative movement trajectory, and the grinding-simulation movement trajectory is formed in combination with the feeding direction of the worktable; and when the phase difference is 0 and π, the tangential ultrasonic vibration is coupled with the axial ultrasonic vibration, so that the abrasive particles of the grinding wheel and the workpiece form two groups of relative movement trajectories in which straight lines intersect with each other, and the honing-simulation movement trajectory is formed in combination with the feeding direction of the worktable.

As shown in FIG. 21, a 220V AC power supply supplies power for an oscillating stage, a power stage and a phase detection part in the ultrasonic generator III-9, the oscillating stage generates an ultrasonic frequency signal, which is amplified by the amplifying stage, the power of the ultrasonic frequency signal is improved by the power stage, and then is transferred to the transducer by impedance matching, the output power of the ultrasonic generator III-9 is compared with the power of the transducer by sampled signal feed, and if the output power of the ultrasonic generator III-9 is not equal to the power of the transducer, the signal is fed back to the oscillating stage and the power stage to produce the power equal to that of the transducer; and the phase detection part and the phase adjustment part can detect and control the phases of the ultrasonic vibration on two directions so as to generate different phase differences to generate different movement trajectories.

FIG. 5, FIG. 7 to FIG. 19 and FIG. 21 are the second embodiment of the present invention, in the second embodiment of the multi-angle two-dimensional ultrasonic vibration assisted nanofluid micro-lubrication grinding device, the multi-angle two-dimensional ultrasonic vibration device I, the nanofluid micro-lubrication grinding device II and the grinding force and grinding temperature measurement device III are the same as those in the first embodiment, the difference lies in that by adjustment of the axial adjustable bracket I-33, the vibration directions of the axial ultrasonic vibrator and the tangential ultrasonic vibrator form an acute angle so as to further improve the relative movement trajectory of the abrasive particles of the grinding wheel II-3 and the workpiece I-12, and the grinding-simulation movement trajectory and the honing-simulation movement trajectory can be more compact so as to achieve the ideal grinding effect.

FIG. 6, FIG. 7 to FIG. 19 and FIG. 21 are the third embodiment of the present invention, the multi-angle two-dimensional ultrasonic vibration device I, the nanofluid micro-lubrication grinding device II and the grinding force and grinding temperature measurement device III in the third embodiment are the same as those in the first embodiment, the difference lies in that by adjustment of the axial adjustable bracket I-33, the vibration directions of the axial ultrasonic vibrator and the tangential ultrasonic vibrator form an obtuse angle so as to further improve the relative movement trajectory of the abrasive particles of the grinding wheel II-3 and the workpiece I-12, and the grinding-simulation movement trajectory and the honing-simulation movement trajectory can be more compact so as to achieve the ideal grinding effect.

FIG. 1 to FIG. 4, FIG. 7 to FIG. 19, FIG. 20(*d*) and FIG. 21 are the fourth embodiment of the present invention, the tangential ultrasonic vibration assisted nanofluid micro-lubrication grinding device and the grinding force and grinding temperature measurement device thereof are the same as the multi-angle two-dimensional ultrasonic vibration device I, the nanofluid micro-lubrication grinding device II and the grinding force and grinding temperature measurement device III in the first embodiment, which can be achieved by just controlling the ultrasonic generator, the ultrasonic generator III-9 is controlled to only output a tangential ultrasonic signal, as the slide rail supporting seat I-8 is connected with the axial supporting seat I-7 through the T-shaped slide block I-38, when the tangential ultrasonic vibrator generates amplitude, the slide rail supporting seat I-8 can freely vibrate along the tangential direction without being interfered by the axial supporting seat I-7, and thus the relative movement trajectory of the abrasive particles of the grinding wheel II-3 and the workpiece I-12 as shown in FIG. 20 (*d*) is generated.

FIG. 1 to FIG. 4, FIG. 7 to FIG. 19, FIG. 20 (*e*) and FIG. 21 are the fifth embodiment of the present invention, the axial ultrasonic vibration assisted nanofluid micro-lubrication grinding device and the grinding force and grinding temperature measurement device thereof are the same as the multi-angle two-dimensional ultrasonic vibration device I, the nanofluid micro-lubrication grinding device II and the grinding force and grinding temperature measurement device II in the first embodiment, which can be achieved by just controlling the ultrasonic generator, the ultrasonic generator II-9 is controlled to only output an axial ultrasonic signal, the axial ultrasonic vibrator drives the axial supporting seat to generate amplitude and transfer the amplitude to the slide rail supporting seat I-8, as the slide rail supporting seat I-8 is connected with the tangential ultrasonic vibrator through the universal ball joint, the axial vibration of the slide rail supporting seat I-8 is not interfered, and thus the relative movement trajectory of the abrasive particles of the grinding wheel II-3 and the workpiece I-12 as shown in FIG. 20 (*e*) is generated.

The Specific Working Process of the Solution is as Follows:

Taking the first embodiment as an example, the ultrasonic generator III-9 generates an ultrasonic frequency electric signal matching the power of the axial transducer I-2 with the power of the tangential transducer I-25, the ultrasonic frequency electric signal is transferred to the axial transducer I-2 or the tangential transducer I-25 through the negative electrode conducting wire III-10 and the positive electrode conducting wire III-11, the axial transducer I-2 and the tangential transducer I-25 convert the ultrasonic frequency electric signal into mechanical vibration of ultrasonic frequency and transfer the mechanical vibration of ultrasonic frequency to the axial amplitude change rod I-2 and the tangential amplitude change rod I-25, the amplitude change rods amplify the amplitude of the mechanical vibration of ultrasonic frequency for a certain fold and transfer the mechanical vibration of ultrasonic frequency to the axial supporting seat I-7 and the slide rail supporting seat I-8 so as to drive the workpiece I-12 and the abrasive particles of the grinding wheel to generate the relative movement trajectory, the universal ball joint is connected with the slide rail and the slide block via the universal ball joint, so that the slide rail supporting seat I-8 generates no system internal stress while being applied to axial and tangential vibration, and thus avoiding the vibration impact damage to the connecting pieces in the ultrasonic vibration system. By controlling the phase adjustment link in the ultrasonic generator III-9 as shown in FIG. 21, the axial ultrasonic vibrator and the tangential ultrasonic vibrator generate ultrasonic vibration signals with different phase difference, when the phase difference is $\pi/2$, the tangential ultrasonic vibration is coupled with axial ultrasonic vibration, so that the abrasive particles of the grinding wheel and the workpiece form the elliptical relative movement trajectory, and the grinding-simulation movement trajectory as shown in FIG. 20 (*b*) is formed in combination with the feeding direction of the worktable; and when the phase difference is 0 and $\pi$, the tangential ultrasonic vibration is coupled with the axial ultrasonic vibration, so that the abrasive particles of the grinding wheel and the workpiece form two groups of relative movement trajectories in which straight lines intersect with each other, and the honing-simulation movement trajectory as shown in FIG. 20 (*c*) is formed in combination with the feeding direction of the worktable. In the second embodiment and the third embodiment, the angle of the axial adjustable bracket I-33 is adjusted to further change the shape of the relative movement trajectory of the abrasive particles of the grinding wheel and the workpiece, so that the veins of the grinding-simulation movement trajectory and the honing-simulation movement trajectory are more compact so as to achieve the ideal surface quality and grinding effect of the workpiece.

The grinding force generated by grinding the workpiece I-12 by the grinding wheel II-3 is transferred by the workpiece fixture I-9 to the slide rail supporting seat I-8, and the tangential grinding force, the normal grinding force and the axial grinding force are respectively transferred to the fixing plate I-6 on three different paths. The tangential grinding force is transferred to the tangential amplitude change rod I-24 via the universal ball joint, the tangential amplitude change rod I-24 is rigidly connected to the tangential bracket I-28, then the tangential bracket I-28 is subjected to the tangential grinding force, and then is transferred to the fixing plate I-6; the normal grinding force is transferred by the T-shaped slide block I-36 to the jack rolling ball I-35, then is transferred to the tangential bracket boss I-42 and is finally transferred to the fixing plate I-6; the axial grinding force is transferred by the T-shaped slide block I-36 to the axial supporting seat I-7, then is transferred to the axial amplitude change rod I-3, the axial amplitude change rod I-3 is rigidly connected with the axially adjustable bracket I-33, so that the axially adjustable bracket I-33 is subjected to the axial grinding force, and the axial grinding force is finally transferred to the fixing plate I-6. The grinding forces on the three directions are transferred by the fixing plate I-6 to the dynamometer III-4, the measurement signal is transferred to the grinding force information collector III-2 after being amplified by the amplifier III-3 and is finally transferred to the grinding force control system III-1, and the size of the grinding force is displayed.

The grinding temperature generated by grinding the workpiece I-12 by the grinding wheel II-3 is transferred by the thermocouple III-5 to the grinding temperature information collector III-6, and then is transferred to the low pass filter III-7, some interference signals are filtered, the grinding temperature is finally transferred to the grinding temperature control system III-8, and the working end temperature of the thermocouple II-5, that is the temperature of the workpiece I-12 is displayed.

After the ultrasonic vibration device completes the experimental processing tasks, the magnetic worktable II-7 is degaussed, and the dynamometer III-4 and the whole equipment can be dismounted.

Multi-Angle Two-Dimensional Ultrasonic Vibration Assisted Nanofluid Micro-Lubrication Grinding Surface Creation Mechanism:

In the process of two-dimensional grinding, a single abrasive particle introduces two-dimensional ultrasonic vibration excitation on the workpiece to cause the same to perform spiral or straight line staggered cutting in the grinding area, within a vibration period, the abrasive particle periodically changes the cutting direction, so that a plurality of grinding edges on the surrounding of the abrasive particle participate in the cutting to form a "multi-edge cutting" process, which is conducive to keeping the sharpness of the cutting edge of the abrasive particle and cooling the grinding temperature on the surface of the workpiece, which is different from the micro are type cutting mode in an ordinary grinding process, the cutting path is longer than that of the ordinary grinding, that is, the cutting action area of the single abrasive particle increases, and the cutting edges of all surfaces of the single abrasive particle periodically contact and cut the workpiece material, an intermittent processing state of sometime cutting and sometime separating in a micro-processing area, and a cutting process which is continuous macroscopically and is discontinuous microscopically is formed. In the process of two-dimensional grinding, and the spiral cutting trajectories formed by the numerous abrasive particles on the grinding wheel interfere with each other to form mutually intertwined cutting trajectories on the grinding surface, thereby forming the unique differential cutting effect of the two-dimensional ultrasonic assisted grinding. The creation process of the two-dimensional ultrasonic assisted grinding surface is not limited to abrasive particle cutting traces without subsequent cutting edges, instead, spiral or linear staggered cutting trajectories of numerous abrasive particles, interfering trajectories to a certain extent can widen the cutting groove of the single abrasive particle, the greater the axial ultrasonic amplitude is, the wider the cutting groove of the abrasive particle is, the material volume removed within a unit time is increased, thereby improving the material removal efficiency, and meanwhile increasing the interference of the numerous abrasive particles, the un-removed traces of the abrasive particles are obviously reduced on the width and height, thereby reducing the roughness of the grinding surface and greatly improving the quality of the grinding surface.

In the two-dimensional ultrasonic assisted vibration grinding process, two-dimensional ultrasonic vibration parallel to the linear velocity direction (x direction) of the grinding wheel and perpendicular to the linear velocity direction (y direction) of the grinding wheel is applied to the workpiece, and the equation of the trajectory of the abrasive particles relative to the workpiece is:

$$x=A\cos(2\pi ft)+vt \tag{6}$$

$$y=B\cos(2\pi ft+\varphi) \tag{7}$$

In the formula, A represents the amplitude of the tangential ultrasonic vibration, B represents the amplitude of the axial ultrasonic vibration, f represents the ultrasonic vibration frequency, v represents a worktable feeding speed, and φ represents the phase difference between the tangential ultrasonic vibration and the axial ultrasonic vibration.

When the worktable is stationary, the worktable feeding speed v=0, the formula (6) and the formula (7) are parameter equations used for expressing the relative movement trajectory of the abrasive particles of the grinding wheel and the workpiece by using the parameter t, after the parameter t is eliminated, a rectangular equation of the trajectory is obtained, and the formula is:

$$\frac{x^2}{A^2}+\frac{y^2}{B^2}-\frac{2xy}{AB}\cos\varphi=\sin^2\varphi \tag{8}$$

This is an elliptic equation, that is, the rectangular equation of the relative movement trajectory of the abrasive particles of the grinding wheel and the workpiece. The elliptic shape is determined by the phase difference φ between the tangential ultrasonic vibration and the axial ultrasonic vibration, and several special cases are discussed below:

when φ=0, that is, the phase difference between the tangential ultrasonic vibration and the axial ultrasonic vibration is equal, at this time, the following formula can be obtained by the formula (8):

$$\frac{x}{y}=\frac{A}{B} \tag{9}$$

Therefore, the relative movement trajectory of the abrasive particles of the grinding wheel and the workpiece is a straight line passing by the origin, and the slope is the ratio of two amplitudes A/B. At the moment t, the displacement of the abrasive particles of the grinding wheel departing from an equilibrium position is:

$$S=\sqrt{x^2+y^2}=\sqrt{A^2+B^2}\cos(2\pi ft+\varphi) \tag{10}$$

Therefore, the frequency of harmonic vibration of the tangential ultrasonic vibration and the axial ultrasonic vibration is equal, the amplitude is equal to $\sqrt{A^2+B^2}$, and vibration is generated along the straight line $$\frac{x}{y}=\frac{A}{B}.$$

When φ=π, the phases of the tangential ultrasonic vibration and the axial ultrasonic vibration are opposite, that is, the abrasive particles of the grinding wheel perform harmonic vibration on another straight line $$\frac{x}{y}=-\frac{A}{B}$$

at the same frequency and the same amplitude. The relative movement trajectories of the abrasive particles of the grinding wheel and the workpiece when φ=0 and φ=π are synthesized to obtain the honing-simulation movement trajectory as shown in FIG. 20 (*c*). When φ=π/2, the following formula can be obtained from formula (8):

$$\frac{x^2}{A^2} + \frac{y^2}{B^2} = 1 \tag{11}$$

That is, the relative movement trajectory of the abrasive particles of the grinding wheel and the workpiece is an ellipse with the coordinate axis as the main axis, the abrasive particles of the grinding wheel move along the elliptic trajectory, as shown in FIG. 20 (*a*). While the abrasive particles of the grinding wheel perform the elliptic motion, the abrasive particles of the grinding wheel perform uniform linear motion along the tangential direction at a feeding speed v, and the obtained relative movement trajectory is the grinding-simulation movement trajectory as shown in FIG. 20 (*b*).

On the basis of controlling the phase adjustment part of the ultrasonic generator to cause the abrasive particles of the grinding wheel and the workpiece to generate different relative movement trajectories, the angle of the axially adjustable bracket is adjusted to further change the inclination angle of the spiral and straight line staggered trajectories, and in cooperation with the nanofluid micro-lubrication grinding working condition, the abrasive particles of the grinding wheel generate more compact texture veins on the surface of the workpiece so as to obtain higher surface quality and grinding effect of the workpiece.

The above descriptions are only preferred embodiments of the present invention, rather than all embodiments of the present invention, and are not used for limiting the present invention, and any modifications, equivalent substitutions, improvements and the like made within the spirit and principle of the present invention should be included in the protection scope of the present invention.

In addition to the technical features described in the specification, the remaining technical features are known to those skilled in the art. To highlight the innovative features of the present invention, the foregoing technical features are not described herein repeatedly.

The invention claimed is:

1. A multi-angle two-dimensional ultrasonic vibration assisted nanofluid micro-lubrication grinding device, comprising a workpiece fixture used for clamping a workpiece and a grinding wheel used for grinding the workpiece, wherein the workpiece fixture is connected with a two-dimensional ultrasonic vibration device to maintain the sharpness of a cutting edge of the grinding wheel; a jetting mechanism used for jetting nanofluid to the workpiece is arranged on one side of the grinding wheel, and the two-dimensional ultrasonic vibration device and nanofluid jetted by the jetting mechanism form two-dimensional ultrasonic vibration and nanofluid micro-lubrication grinding coupling of the workpiece; the two-dimensional ultrasonic vibration device comprises a tangential ultrasonic vibration device and an axial ultrasonic vibration device, and the tangential ultrasonic vibration device is arranged above or below the axial ultrasonic vibration device; and the axial ultrasonic vibration device is rotatably arranged relative to the tangential ultrasonic vibration device.

2. The multi-angle two-dimensional ultrasonic vibration assisted nanofluid micro-lubrication grinding device of claim 1, wherein the tangential ultrasonic vibration device is arranged on a fixing plate, the fixing plate is arranged on a worktable, the axial ultrasonic vibration device is arranged above the tangential ultrasonic vibration device, the fixing plate is connected with a dynamometer, and the dynamometer is connected with a grinding force control system.

3. The multi-angle two-dimensional ultrasonic vibration assisted nanofluid micro-lubrication grinding device of claim 2, wherein the tangential ultrasonic vibration device is fixed to the fixing plate through a tangential bracket with an L-shaped longitudinal section, the top of the tangential bracket supports a tangential amplitude change rod, one end of the tangential amplitude change rod is connected with a tangential transducer, the tangential transducer is connected with an ultrasonic generator, the other end of the tangential amplitude change rod is fixed with a slide rail supporting seat through a universal joint, and the slide rail supporting seat supports the workpiece fixture.

4. The multi-angle two-dimensional ultrasonic vibration assisted nanofluid micro-lubrication grinding device of claim 3, wherein a shaft shoulder neck is formed in the top of the tangential bracket, a shaft shoulder matched with the shaft shoulder neck is arranged on the circumference of the tangential amplitude change rod, and a tangential bracket cover covers the shaft shoulder and is fixed with the tangential bracket.

5. The multi-angle two-dimensional ultrasonic vibration assisted nanofluid micro-lubrication grinding device of claim 4, wherein a workpiece groove used for fixing the workpiece is formed in the surface of the slide rail supporting seat, a workpiece locating stop block capable of moving axially is arranged in the workpiece groove, and a fixture bolt or screw capable of moving tangentially is arranged in the workpiece groove.

6. The multi-angle two-dimensional ultrasonic vibration assisted nanofluid micro-lubrication grinding device of claim 4, wherein a projection is arranged on the other side of the tangential bracket fixed with the fixing plate on the tangential bracket, the axially adjustable bracket is rotatably fixed to the tangential bracket through the projection, and the axial ultrasonic vibration device is supported by the axially adjustable bracket;

further, a dial is arranged on the surrounding of the projection of the tangential bracket so as to indicate the rotation angle of the axially adjustable bracket relative to the tangential bracket;

further, the longitudinal section of the axially adjustable bracket is L-shaped; and further, the height of the axially adjustable bracket is smaller than that of the tangential bracket.

7. The multi-angle two-dimensional ultrasonic vibration assisted nanofluid micro-lubrication grinding device of claim 1, wherein a temperature collection element is arranged on the workpiece fixture or the workpiece, and the temperature collection element is connected with a temperature control system.

8. The multi-angle two-dimensional ultrasonic vibration assisted nanofluid micro-lubrication grinding device of claim 7, wherein the axial ultrasonic vibration device comprises an axial amplitude change rod, one end of the axial amplitude change rod is connected with an axial transducer, the other end of the axial amplitude change rod is connected with an axial supporting seat, and the axial supporting seat is arranged in a depression on a lower surface of the slide rail supporting seat or an upper surface of the slide rail supporting seat through a T-shaped slide block;

the axial transducer is connected with the ultrasonic generator;

an arc-shaped slot for limiting the movement trajectory of the axial ultrasonic vibration device is arranged on the fixing plate, a slide bar is arranged on the axially adjustable bracket, and the slot moves along an arc-shaped slide rail; and further, the chute is a T-shaped chute, and the slide bar can be replaced by a locating bolt.

9. The multi-angle two-dimensional ultrasonic vibration assisted nanofluid micro-lubrication grinding device of claim 8, wherein a slide block rolling ball is arranged on at least one side face of the T-shaped slide block to avoid the vibration damage to the slide rail supporting seat and the axial supporting seat; and or, a jack is arranged at the bottom of the T-shaped slide block, a jack rolling ball is arranged on a contact surface of the jack and the T-shaped slide block to reduce the energy consumed by the friction between a bottom surface of the T-shaped slide block and the jack.

10. The multi-angle two-dimensional ultrasonic vibration assisted nanofluid micro-lubrication grinding device of claim 1, wherein the jetting mechanism comprises a nozzle, the grinding wheel is fixed in a grinding wheel cover, nozzles are respectively fixed to one or both sides of the bottom of the grinding wheel, and the nozzle is separately connected with a nanofluid conveying pipe and a compressed air conveying pipe; and further, the nanofluid conveying pipe and the compressed air conveying pipe are fixed on the side face of the grinding wheel cover through a magnetic suction cup.

* * * * *